US006659452B2

(12) United States Patent
Abe et al.

(10) Patent No.: US 6,659,452 B2
(45) Date of Patent: Dec. 9, 2003

(54) AUTOMATIC BILL STORAGE DEVICE

(75) Inventors: Hiroshi Abe, Iwatsuki (JP); Takahito Yamamiya, Iwatsuki (JP)

(73) Assignee: Asahi Seiko Co., Ltd., Tokyo (JP)

( * ) Notice: Subject to any disclaimer, the term of this patent is extended or adjusted under 35 U.S.C. 154(b) by 0 days.

(21) Appl. No.: 10/132,230

(22) Filed: Apr. 25, 2002

(65) Prior Publication Data

US 2002/0175463 A1 Nov. 28, 2002

(30) Foreign Application Priority Data

Apr. 27, 2001 (JP) ..... 2001-131842
Oct. 15, 2001 (JP) ..... 2001-316796

(51) Int. Cl.[7] ..... B65H 29/46
(52) U.S. Cl. ..... 271/181; 271/177; 271/180
(58) Field of Search ..... 271/180, 181, 271/177

(56) References Cited

U.S. PATENT DOCUMENTS 4,678,072 A * 7/1987 Kobayashi et al. ..... 194/206
5,209,395 A * 5/1993 Zouzoulas et al. ..... 232/15
5,286,017 A * 2/1994 Hawk et al. ..... 271/303
5,372,361 A 12/1994 Isobe et al.
5,836,435 A 11/1998 Fujita et al.
5,876,033 A * 3/1999 Lonati ..... 271/298
5,899,452 A * 5/1999 Walsh ..... 271/180
6,244,589 B1 6/2001 Gerlier

FOREIGN PATENT DOCUMENTS

GB 2338704 A * 12/1999 ..... B65H/29/44
JP 58-109354 6/1983

* cited by examiner

*Primary Examiner*—Donald P. Walsh
*Assistant Examiner*—Matthew J. Kohner

(57) ABSTRACT

An automatic bill storage device for storing bills of different widths or sizes, includes a bill loading device for receiving a bill and positioning it at an initial storage position. A bill contact device can then engage the bill at the initial storage position and translate the bill to other side of a restraining device to a storage location that is biased by a movable plate. A contact member can contact an intermediate portion of the bill and translate the bill by a moving contact that extends from the intermediate portion of the bill towards one end of the bill as the bill is moved towards the storage location. This looping movement of contact can accommodate bills of different width in a compact configuration and can permit an initial bending of the bills from the initial storage position to aligning the bills so that they are straightened so that they can be stored in a stacked array in an efficient and compact manner.

20 Claims, 25 Drawing Sheets

AUTOMATIC BILL STORAGE DEVICE

BACKGROUND OF THE INVENTION

1. Field of the Invention

The present invention is related to an automatic bill storage device which stores accommodated bills and more specifically to an automatic bill storage device in which a bill is contacted by a pair of storing bars which move in a loop-like motion within and outside the safe to move the bill into storage.

2. Description of Related Art

In this specification, "bill" is a generic term which may include a banknote, folding money, a script, a check a security bond, a coupon or a ticket, or any other elongated flexible members which are to be stored in a stacked arrangement.

An example of the prior art for an automatic bill storage device for storing money in a safe can be found in the Japanese patent publication 8-109354. In this prior art, a receiving bill is held in a safe by posts which are fixed to a pair of rotating disks which rotate in opposite directions from each other. This prior art is relatively inexpensive because of its simple structure. However, it requires a large space because it can not hold bills in the rotating area of the posts. Other examples of prior art can be found in U.S. Pat. Nos. 6,244,589 and 5,836,435 which discloses various configurations of stacking banknotes in a cash box.

The industry is still seeking a compact and efficient bill storage apparatus.

SUMMARY OF THE INVENTION

The present invention is directed to an automatic bill storage device for storing bills in a compact and efficient manner, and more particularly to an automatic bill storing device that includes a bill loading device for initially receiving a bill and positioning it at an initial storage position within the bill storage device. The bill can be initially validated to determine if it is genuine before it is translated to the initial storage position. The storage space for the bills can include a retainer member that is located on one side of the initial storage position. The bill can be moved, for example, by belts and/or rollers to the initial storage position and a bill contact device can engage the bill at the initial storage position and translate the bill to the other side of the retaining device to the storage location. The retaining device can have an aperture at its center for permitting the bill to move to the storage location. A spring biased support plate can be biased towards the initial storage position to provide a support for the stored bills.

A contact member can contact an intermediate portion of the bill and translate the bill past the retaining member and if the retaining member has an aperture through the aperture with the contact member providing a moving contact to the surface of the bill as it extends from the intermediate portion of the bill towards one end of the bill as it is moved towards the storage location and extended in one plane. A second bill contact member can also be utilized to both push the bill towards the storage location and to maintain the position of the bill as the first contact member translates from an intermediate position towards one end of the bill. In one embodiment of the invention, a pair of contact members can be pivotally mounted to respectively contact intermediate portions of the bill and then to extend a pushing contact towards the opposite ends of the bill as it is moved towards the storage location. The respective contact members move in a loop-like motion as they translate along the length of the bill. The particular configuration of the components in the manner in which the components relatively move help facilitate a compact design to enable the automatic bill storage device to be utilized, for example, in vending machines. The bills can be stored in a manner in which they are not folded, but remain in a straight condition, and can be stored in a stacked array within a safe box, which is located on the other side of the aperture opening. Additionally, since the pair of contact members can contact the bill initially at an intermediate position as it is forced through either an aperture in a restraining device, or around the edge of a restraining device, the bills need not be precisely located, but can still be drawn safely into the storage location. In one embodiment, a storing bar can contact an intermediate or central point of the bill, while the contact members can extend in traverse directions from the storing bar for bending and moving the bill from the initial storage position to the storage location.

An alternative device can have a holding member contacting a lower portion of the bill as the contact member forces the bill around a restraining member and again extends traverse to the movement of the bill towards one end of the bill on the other side of the restraining member.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art of storing bills and particularly automates consoles that deal with monetary bills.

Figure 1:
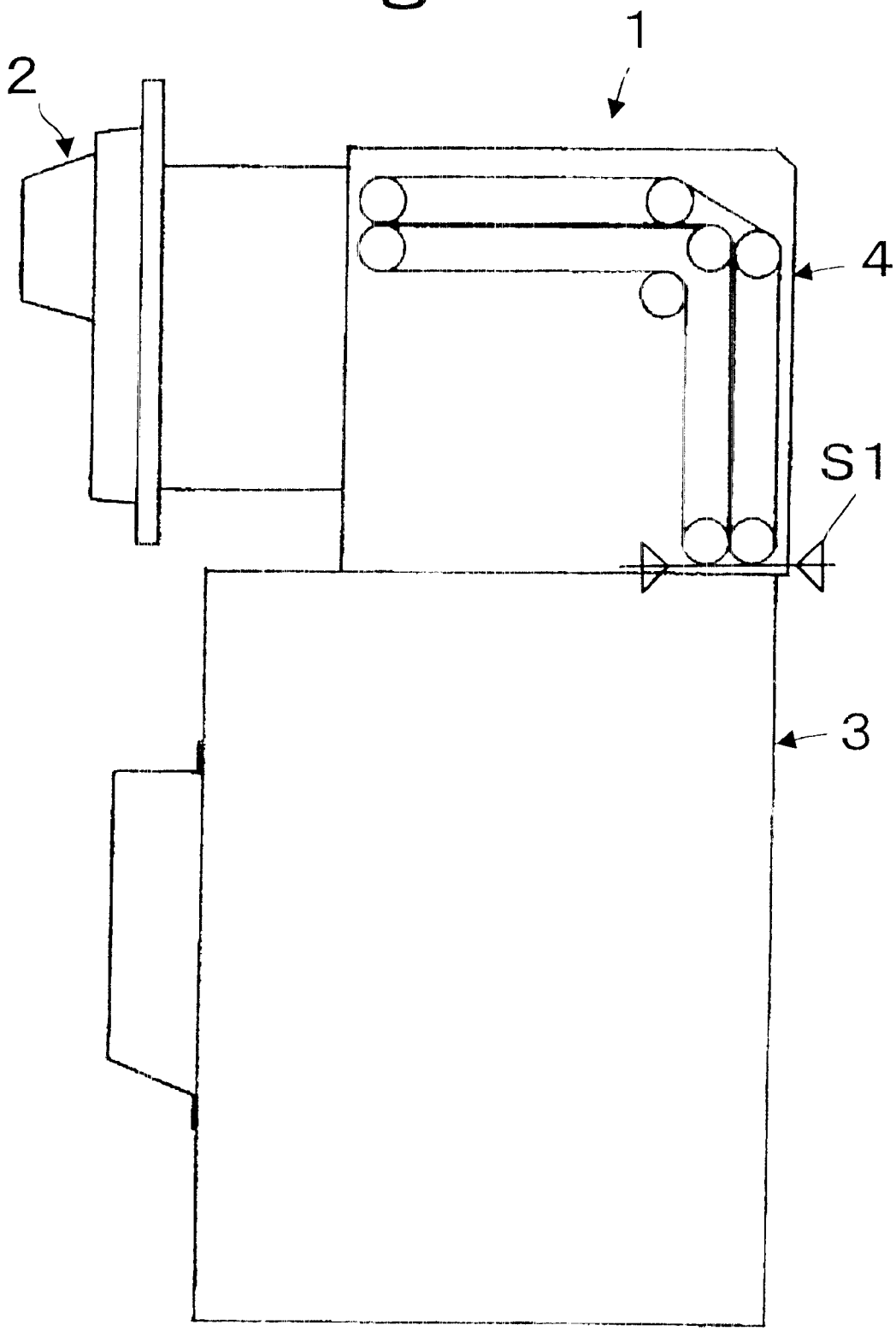
FIG. 1 is a side view of a first embodiment of the invention.

In FIG. 1, a bill acceptor 1 comprises an accepting device 2 for receiving bills, a storing device 3 for safely accumulating stored bills, and a transporting device 4 for moving accepted bills into storage. A bill which has been verified by the accepting device 2 is then transported to storing device 3 by a belt within the transporting device 4 to be stored in the safe box. Bill acceptor 1 can be installed in a vending machine. A jamming sensor S1 which can include an optical-type sensor is located in the front of the entrance of the storing device 3.

Figure 2:
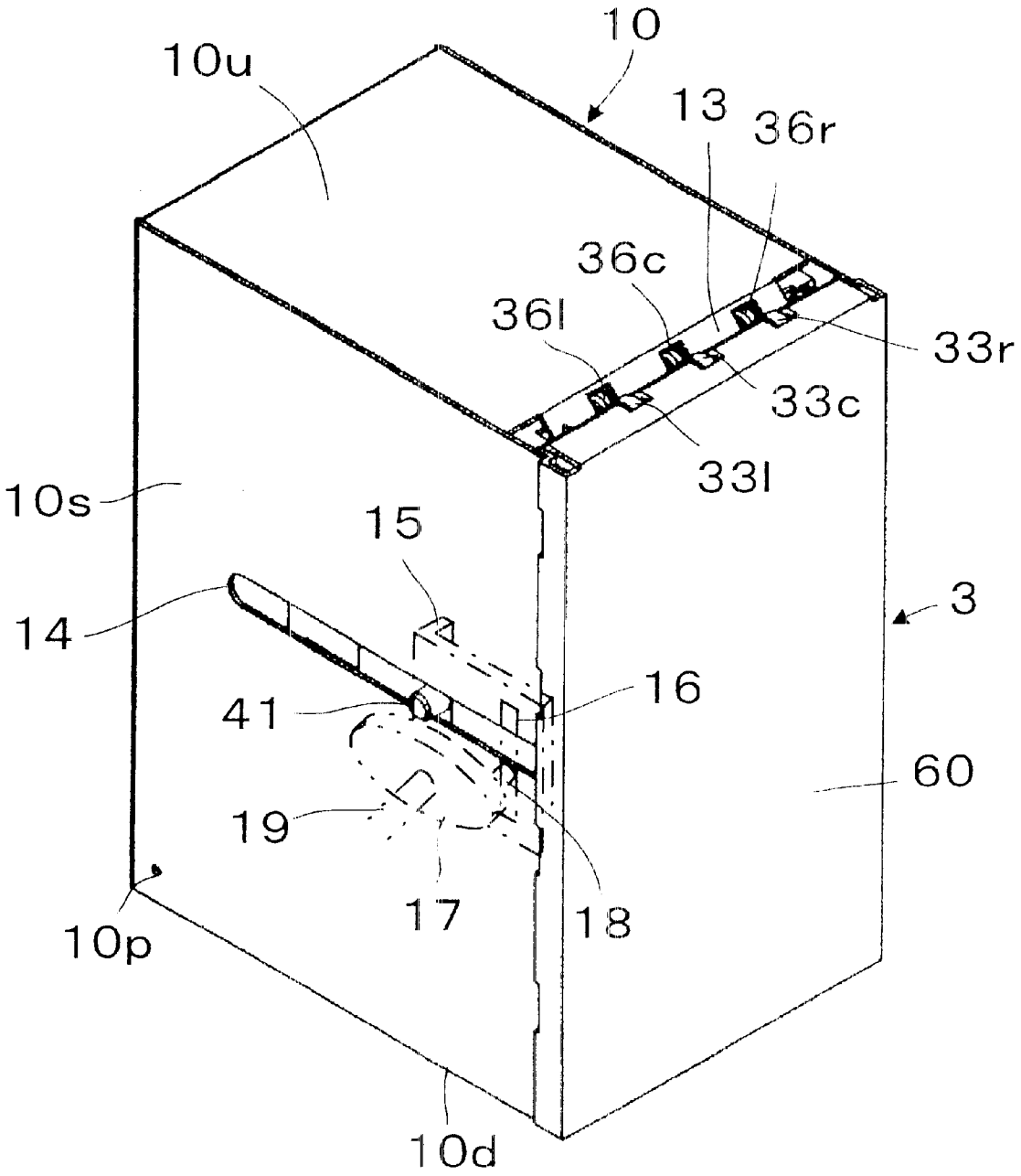
FIG. 2 is a perspective view of a first embodiment which shows a left-hand side view.
Figure 3:
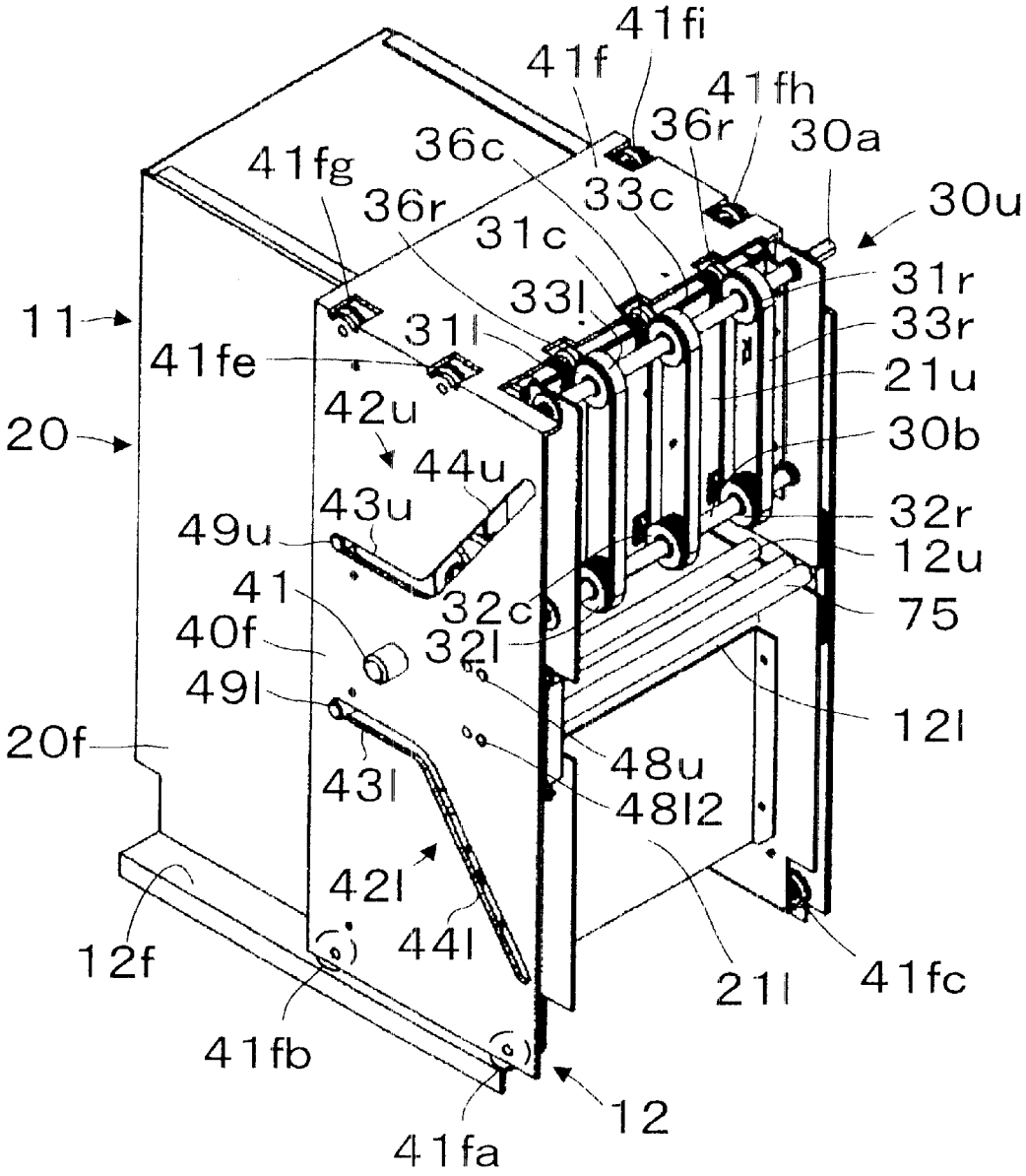
FIG. 3 is a perspective view of a first embodiment with an outside frame removed.

Storing device 3 shown in FIGS. 2 and 3 is box like in shape and comprises an outer housing or case 10, a safe 11, a transporting device 30*u*, driving device 40, a pair of storing bars 12*u*, 12L and lid 60. Outer case 10 has a removable door 10*d* which pivots with pin 10*p* at the bottom of the storing device 3. Safe 11 is box-like in shape as shown in FIG. 3 and stores the bills on its inside and is the inner case of outer case 10. Driving device 40 is located at a storing space which is between safe 11 and outer case 10. Lid 60 is detachable to the outer case 10 and covers the transporting device 30*u*. A receiving opening 13 passes through a bill from the accepting device 2 and is slit like in shape and is formed at upper-board 10*u* of the outer case 10. An oblong elongated hole 14 is formed on side board 10*s* of the outer case 10. Driven pin 41 of the driving device 40 passes through the elongated hole 14 and protrudes through the outside of outer case 10.

Driving piece 15 which is an L-shaped section is located at the vending machine side and is moveable in the horizontal direction which is guided by a guiding-rail (not shown). Pin 18 protrudes from crank 17 and is located at an elongated hole 16 which extends in the longitudinal direction, and can move along elongated hole 16. Crank 17 is fixed at rotating shaft 19 which is rotated by an electric motor (not shown). Therefore, driving piece 15 moves backwards and forwards by one rotation of crank 17. Driven pin 17 is moved to the right by driving piece 15 as shown in FIG. 2. Driven pin 41 is accompanied with drive piece 15, because it is drawn by springs 98*a*, 98*b*, and 98*d*.

Figure 6:
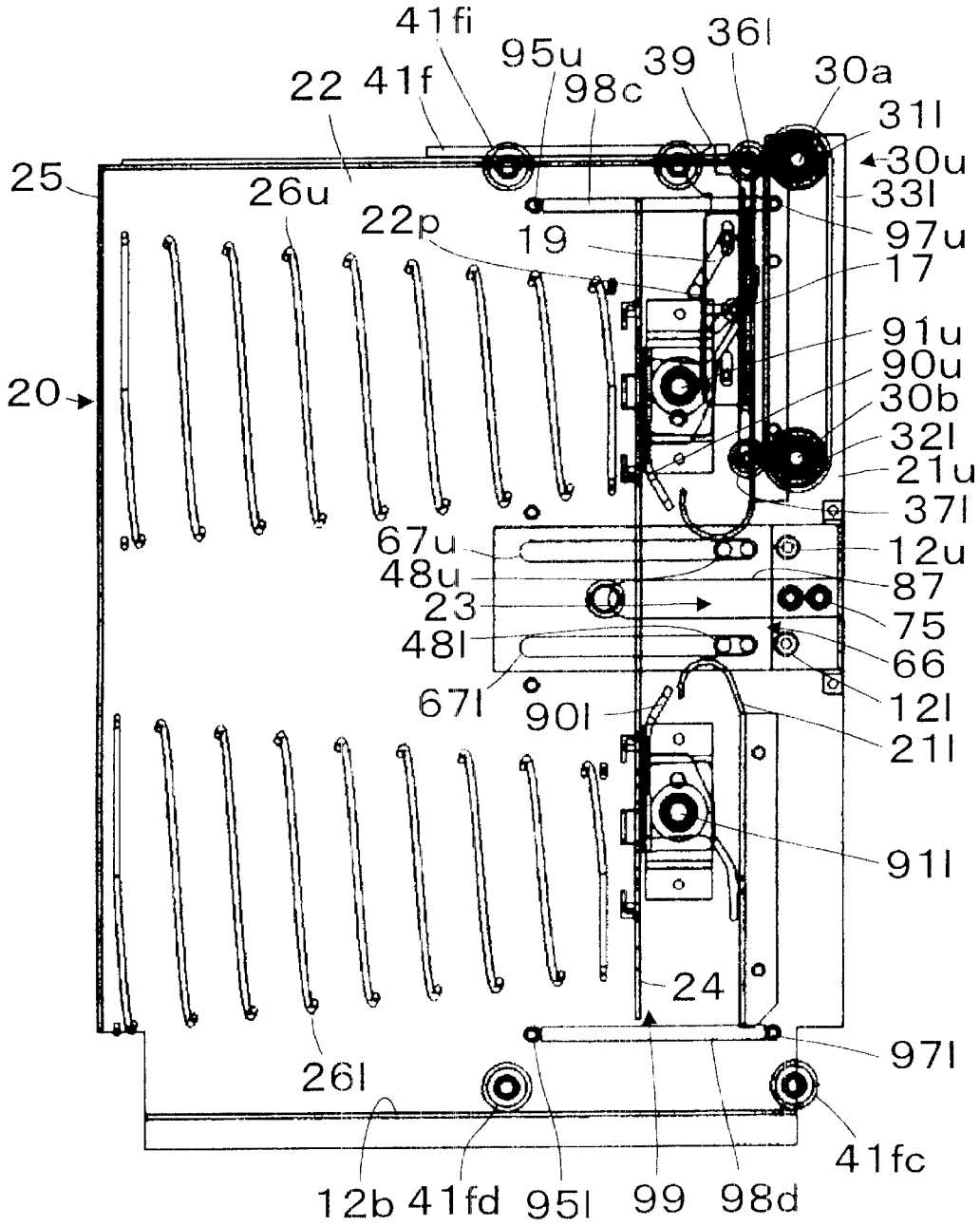
FIG. 6 is a cross section view of the first embodiment.
Figure 7:
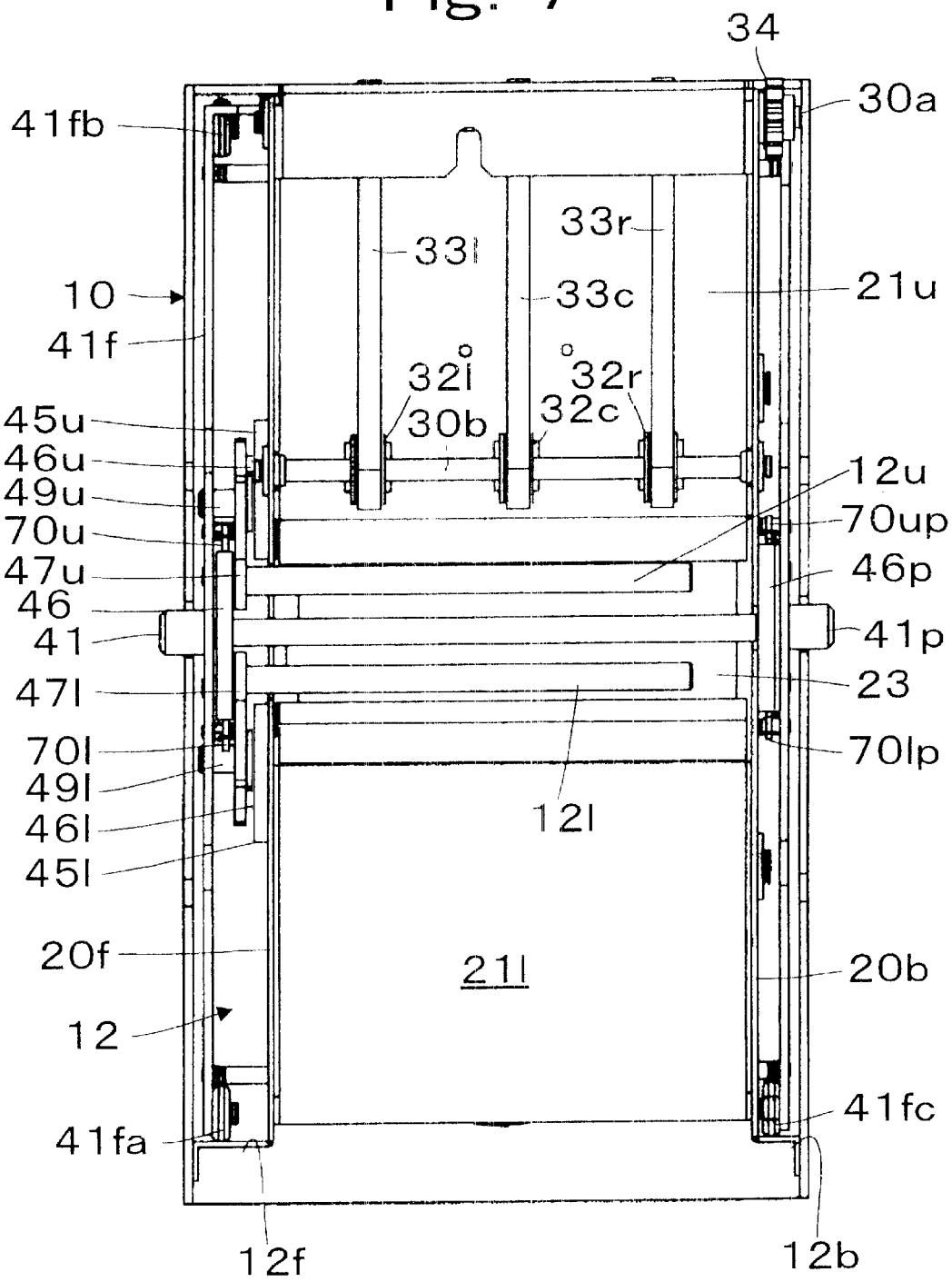
FIG. 7 is a partial front elevation view.

As shown in FIGS. 6 and 7, a bill storing space 22, which is box-like in shape and is opened at the bottom side, comprises a base box 20, a first right wall 21*u* and second right wall 21L. Base box 20 is box-like in shape and bottom side and right hand side have openings. First right wall 21*u* and second right all 2L are channel-like in shape and are inserted at the right side of base box 20 and are fixed. First guide 12*f* is the upper surface 20*f* and is also bent at base box 20. Also, second guide 12*b* is the upper surface 20*f* on the right hand side. A gap which is located between first right wall 21*u* and second right wall 21L, is located at the middle of base box 20. This gap is the bill receiving opening 23. A rectangle-shaped pusher 124 is located in the bill storing space 22 and pushes the received bills to the desired location. Pusher 24 is fixed at the right hand end of a pair of coil springs 26*u* and 26L which are fixed at the left hand wall 25.

Bill transporting device 30*u* is located adjacent first right wall 21*u*. Shaft 30*a* and 30*b* rotate across first right wall 21*u*. Pulleys 31L, 31*c* and 31*r* are fixed to both ends of shaft 30*a* and to the middle of shaft 30*a*. Gear 34 (shown in FIG. 7) is fixed to the end of shaft 30*a* and is driven by the driving source (not shown) of transporting device 4 and is synchronized with transporting device 4. Also, pulleys 32L, 32*c*, and 32*r* are fixed to both ends of shaft 30*b* and to the middle of shaft 30*b*.

Driving belt 33L is wound around pulleys 31L and 32L while driving belt 33*c* is wound around pulleys 31*c* and 32*c*. Also, driving belt 33*r* is wound around pulleys 31*r* and 32*r*. The surfaces of driving belts 33L, 33*c* and 33*r* are positioned at a predetermined distance from first right side wall 21*u* and are parallel. As shown in FIG. 6, the lower section of the first right side wall 21*u* is semicircle-like in shape in order to permit the bills to be guided smoothly. Second right side wall 21L is located slightly to the left from first right side wall 21*u*, and they are parallel. The upper section of second right side wall 21L is semicircle-like in shape. Therefore, the bills are guided smoothly. The lower end of the bills which are sent downwards by the bill transporting device 30*u* do not become jammed as the upper end of second right side wall 21L, and the second right side wall 21L are shifted for the first right side wall 21*u* to the upper section of the second right side wall 21L which is semicircle-like in shape.

Figure 8:
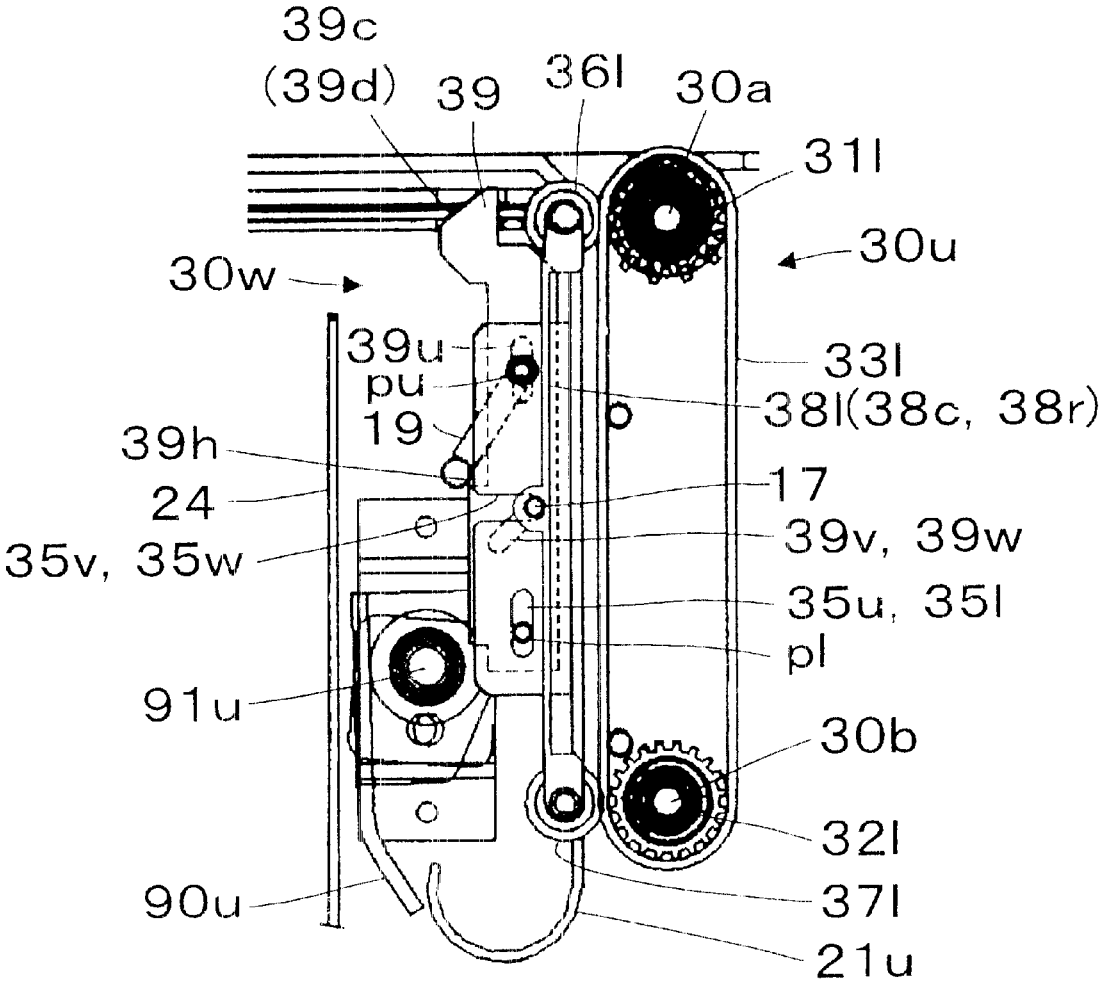
FIG. 8 is a partial view of a bill transporting device.
Figure 9:
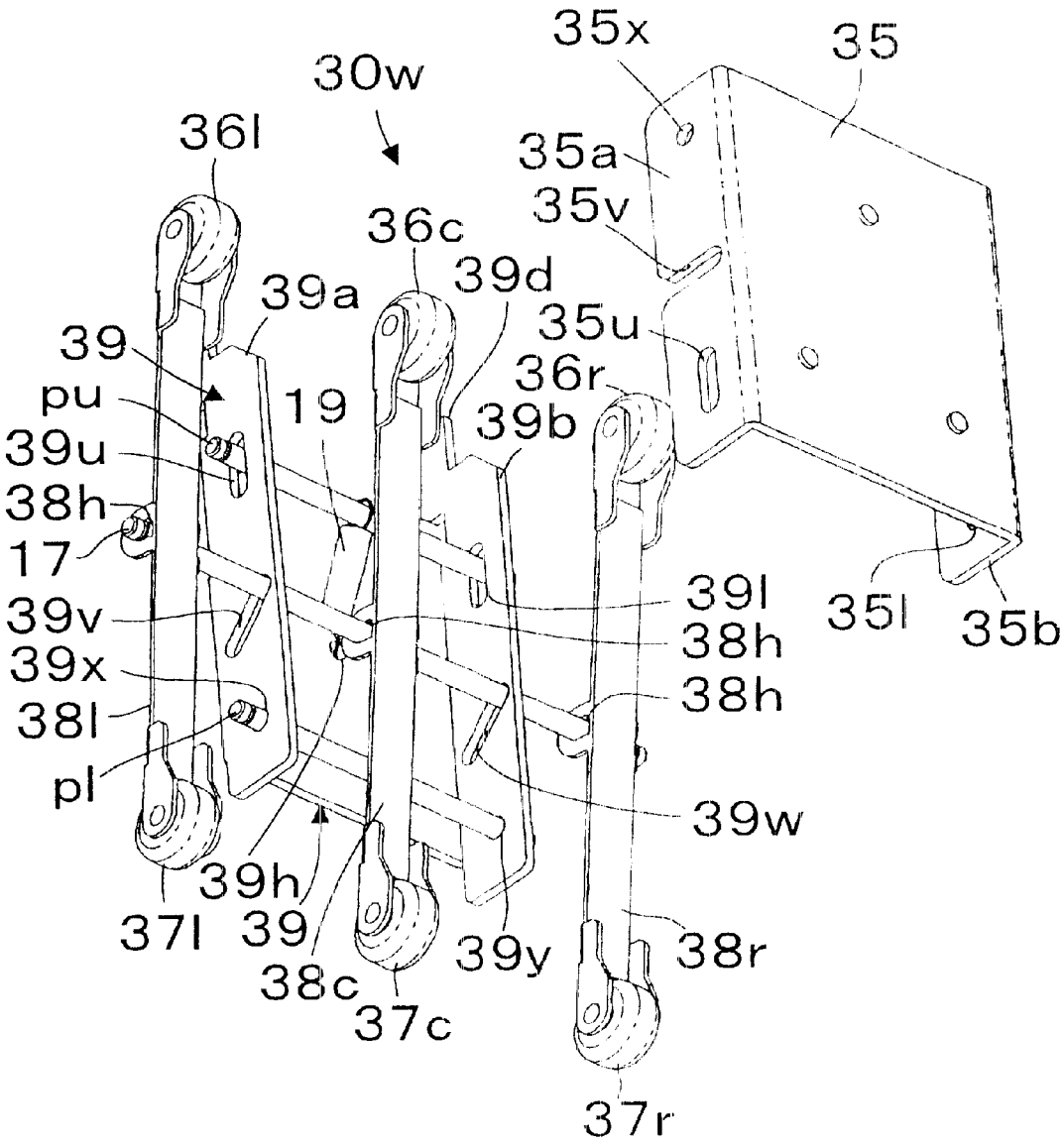
FIG. 9 is an exploded perspective view of a holding device of a bill transporting device.

Next, the pushing device 30*w* of bill transporting device 30*u* is explained by referring to FIGS. 8 and 9. Elongated holes 35*u* and 35*w*, lying grooves 35*v* and 35*w* and round holes 35*x* and 35*y* are perforated at vertical walls 35*a* and 35*b* of fixed guide 35 which is channel-like in shape. Elongated holes 35*u* and 35*w* are extended in the vertical direction and are located at the lower section. Lying grooves 35*v* and 35*w* are extended to be level and are located at the middle section. Round holes 35*x* and 35*y* are located at the upper section. Lying grooves 35*w* and round hole 35*y* are perforated at vertical wall 35*b* from lying grooves 35*v* and round hole 35*x*.

Sliding piece 39 is channel-like in shape and can slide along the fixed guide 35. Slanting surfaces 39*c* and 39*d* are formed at vertical walls 39*a* and 39*b* at the top of sliding piece 39. Elongated holes 39*u* and 39L which are elongated in the vertical direction are perforated at the upper section of vertical walls 39*a* and 39*b*. Slanting holes 39*v* and 39*w* are perforated at the middle section of vertical walls 39*a* and 39*b*. Round holes 39*x* and 39*y* are perforated at the lower section of vertical walls 39*a* and 39*b*.

Rollers 36L, 36*c* and 36*r* are located at pulleys 31L, 31*c* and 31*r*. Also, rollers 37L, 37*c* and 37*r* are located at pulleys 32L, 32*c* and 32*r*. Rollers 36L and 37L are rotatable and attached at the upper and lower ends of leaf spring 38L. Rollers 36*c* and 37*c* are rotatable and attached at the upper and lower ends of leaf spring 38*c* which is the same shape as leaf spring 38L. Rollers 36*r* and 37*r* are rotatable and attached at the upper and lower ends of leaf spring 38*r* which is the same shape as leaf spring 38L.

Pin 17 goes through penetration holes 38*h* at the middle of leaf springs 38L, 38*c*, and 38*r*. The end of pin 17 passes through lying grooves 35*v* and 35*w*, fixed guide 35 and slanting-elongated holes 39*v* and 39*w*. Therefore, pin 17 can move in lying grooves 35*v* and 35*w* of fixed guide 35 because it is pushed up and down by slanting elongated holes 39*u* and 39L. Pin pu, which is fixed at first right hand wall 21*u*, passes through elongated holes 39*u* and 39L of sliding piece 39 and round holes 35*x* and 35*y* of fixed guide 35. The middle of pin pL, which is fixed at first right hand side wall 21*u*, is inserted into round holes 39*x* and 39*y* and is fixed. Also, the end of pin pL is inserted at elongated holes 35*u* and 35L of fixed guide 35. Therefore, sliding piece 39 can move up and down by elongated holes 39*u*, 39L, 35*u*, 35L and pin pL.

Sliding piece 39 is pulled upwards by spring 19 which is hooked to hole 39*h* and pin pu. Therefore, if sliding piece 39 moves into the bill storing space 22 by driving frame 41*f*, the sliding piece 39 is pushed in bill storing space 22 as shown in FIG. 8. Also, pin 17 moves toward the right by contact with slanting elongated holes 39*v* and 39*w* as shown in FIG. 8. At this point, rollers 36L, 36*c*, 36*r*, 37L, 37*c* and 37*r* have contact with belts 33L, 33*c*, and 33*r*. If the bill is inserted into the opening of the vending machine, the bill is drawn in by rollers 36L, 36*c*, 36*r* and belts 33L, 33*c*, 33*r*. If driving flame 41*f* moves to the left as shown in FIG. 8 and sliding piece 39 moves upwards, pin 17 moves towards the right by slanting elongated holes 39*v* and 39*w*. Therefore, rollers 36L, 36*c*, 36*r*, 37*l*, 37*c*, and 37*c* are pushed to the left from belts 33L, 33*c*, and 33*r* or they are slightly pushed by belts 33L, 33*c*, and 33*r*. In this case, the bill can be drawn between rollers 36L, 36*c*, 36*r*, 37L, 37*c*, 37*r* and belts 33L, 33*c*, 33*r*.

Bill transporting device 30*u* has the function of transporting the bills towards a predetermined direction and when the bills are drawn in the bill storing space 22, the bills are released from rollers 36L, 36*c*, 36*r*, 37L, 37*c*, 37*r* and belts 33L, 33*c*, 33*r*. Therefore, bill transporting device 30*u* could also be changed to rollers from belts. Also, the bill transporting device, which is the same structure for bill transporting device 30*u*, can be located at second right hand wall 21L. Bill transporting device 30*u* and second right hand side wall 21L are covered by rectangle-shaped lid 60 which is detachable from the outside case 10.

Figure 4:
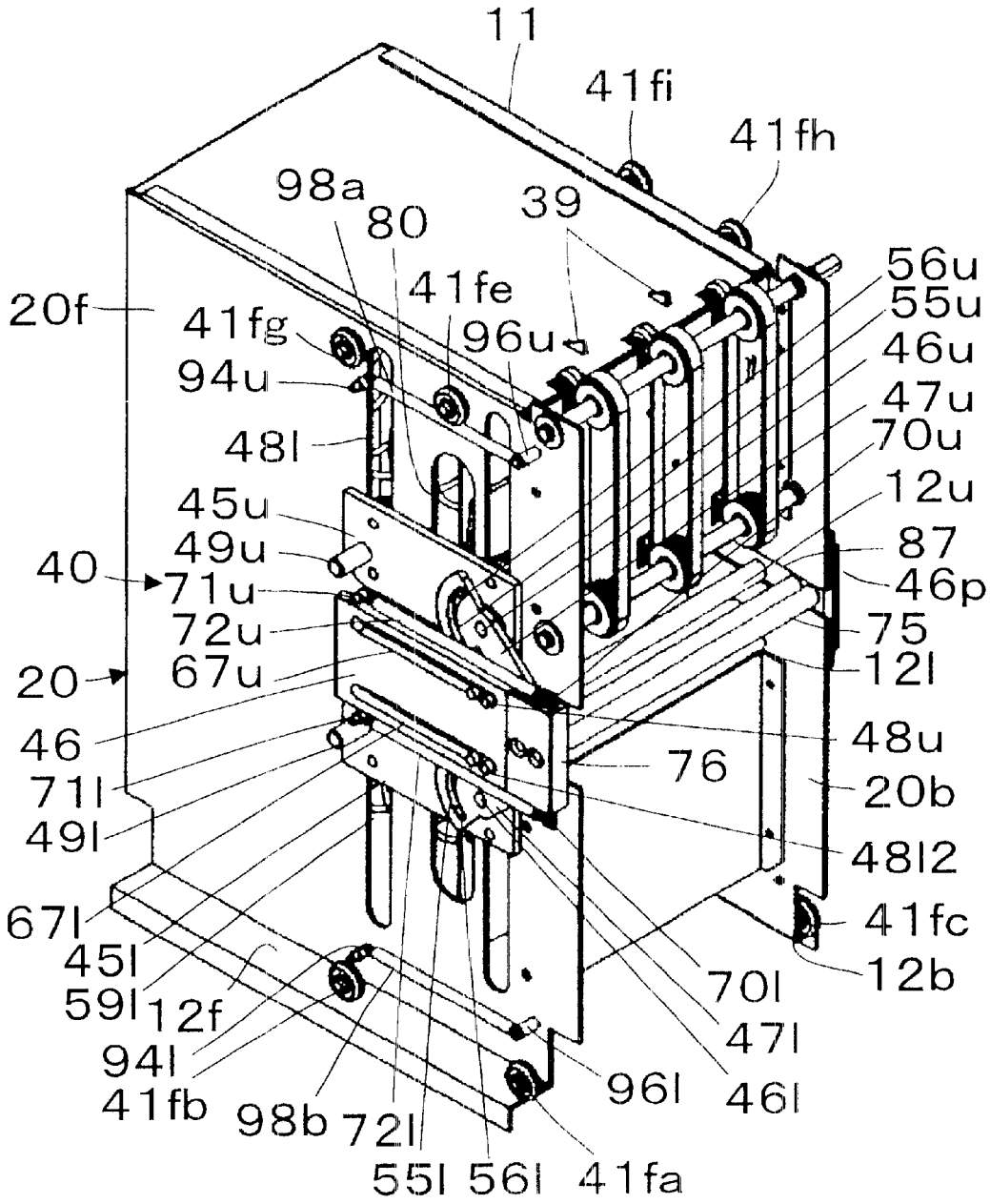
FIG. 4 is a perspective view of a first embodiment with a coverplate removed.

Next, driving device 40 is explained by referring to FIGS. 3 and 4. Driving device 40 comprises driving frame 41*f*, first cam groove 42*u*, second cam groove 42L, first slide base 45*u*, second slide base 45L, slide base 46, first lever 47*u*, second lever 47L and T-shaped guiding groove 80 of safe 11. As shown in FIG. 3, safe 11 is covered by driving frame 41*f* which is channel-like in shape at holding space 12. Roller 41*fa*, 41*fb*, 41*fc*, and 41*fd* are rotatable and attached at both sides of the lower section of driving frame 41*f*. Rollers 41*fa* and 41*fb* roll on first guide 12*f*. Rollers 41*fc* and 41*fd* roll on second guide 12*b*. Rollers 41*fe*, 41*fg*, 41*fh*, and 41*fi* are rotatable and are attached at the upper sections of driving frame 41*f*. Rollers 41*fe*, 41*fg*, 41*fh*, and 41*fi* are guided by the inner surface of outside case 10. Driven pin 41 is fixed at the middle of driving frame 41*f* The driving frame 41*f* reciprocates towards the side direction by driving piece 15 on the outside of safe 11. Pins 94*u* and 94L are fixed at the upper section and at the lower section of the inner surface of driving frame 41*f*. Pins 95*u* and 95L are fixed at the upper section and at the lower section of the inner surface of driving frame 41*f* as shown in FIG. 6. Pins 96*u* and 96L are fixed at front wall 20*f* and pins 97*u* and 97L are fixed at back wall 20*b* as shown in FIG. 6.

Spring 98*a* is hooked between pin 94*u* and pin 96*u*, spring 98*b* is hooked between pin 94L and pin 96L, spring 98*c* is hooked between pin 95*u* and pin 97*u* and spring 98*d* is hooked between pin 95L and pin 97L. Driving frame 41*f* is pulled towards the right (shown in FIG. 3) by the springs. Driving frame 41*f* is stopped by the inner wall of outside case 10 and is located at a predetermined position. Also, first cam groove 42*u* and second cam groove 42L are located at driving frame 41*f*. First cam groove 42*u* consist of first level section 43*u* which is located at the middle of safe 11 and which is extended towards the moving direction of driving frame 41*f*, and first slant section 44*u* which slants towards the upper wall of safe 11. Second cam groove 42L consists of second level section 43L, which is parallel to first level section 43*u*, and first slant section 44*u*, which slants towards the upper wall of safe 11.

Figure 5:
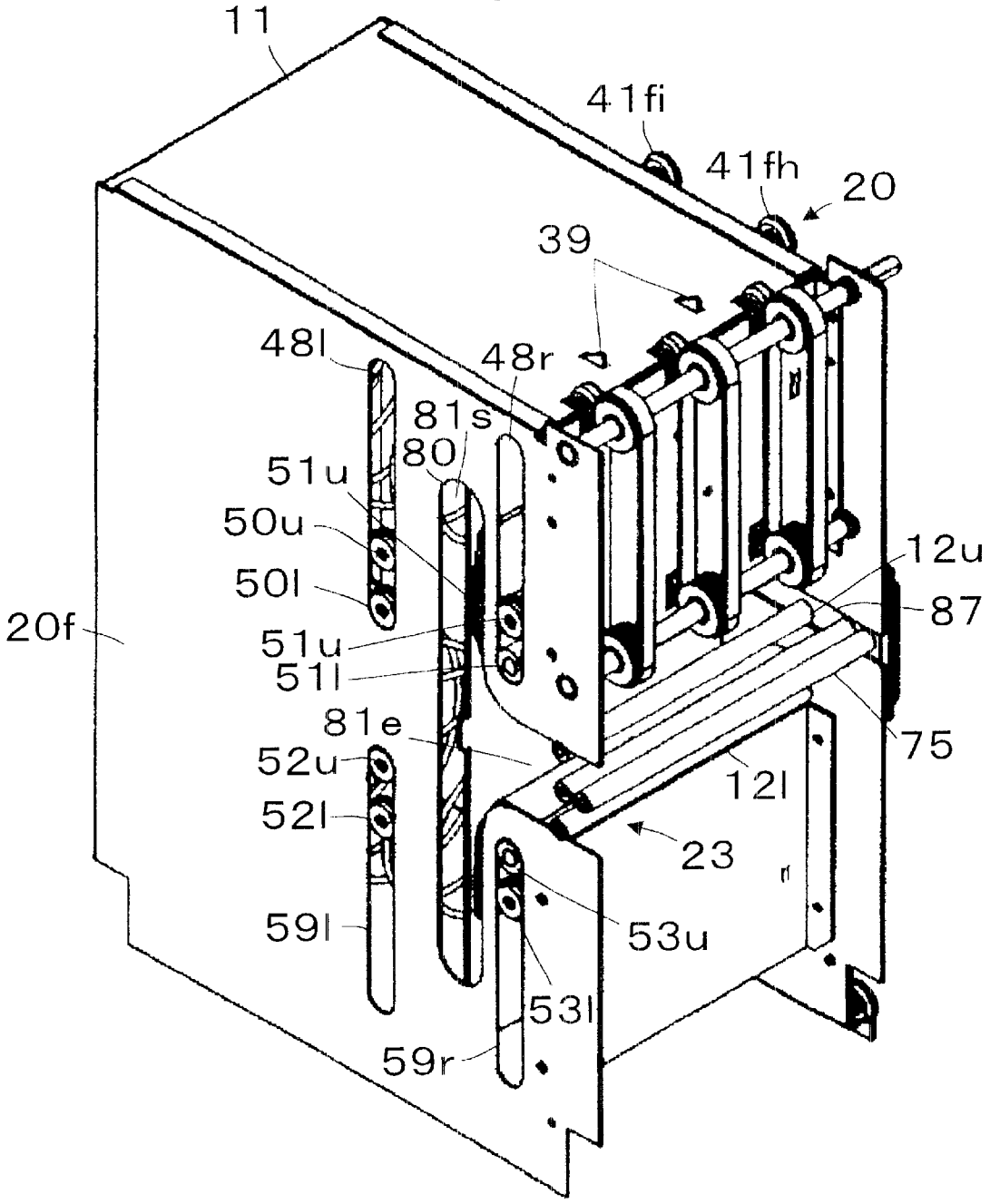
FIG. 5 is a perspective view of a first embodiment with a side plate removed.

As shown in FIG. 4, first slide base 45*u* and second slide base 45L, which make up a pair, pins 46*u* and 46L, which penetrate from slide bases 45*u* or 45L, first lever 47*u* and second lever 47L are pivoted by pins 46*u* and 46L between safe 11 and driving frame 41*f* (not shown) and slide base 46 which can slide levelly outside of slide base 45*u* and 46L. Guiding grooves 48L and 48*r*, which correspond to first sliding base 45*u* are located at front wall 20*f* of safe 11 and are moveable in the vertical direction and are parallel as shown in FIG. 5. Also, guiding grooves 59L and 59*r*, which correspond to second sliding base 45L are located at front wall 20*f* of safe 11 and are movable in the vertical direction at front wall 20*f*.

The respective levers 47*u* and 47L have storing bars 12*u* and 12L that can contact an intermediate portion of a bill b at an initial storage or load position and can translate the bill to a storage location. During translation of the bill, the storing bars 12*u* and 12L can provide a moving contact to fold the bill and to move towards opposite ends of the bill to straighten the bill for storage in an array of bills.

Guiding rollers 50*u* and 50*l*, which are rotatable and attached at first sliding base 45*u*, are movable within guiding groove 48L. Therefore, the guiding grooves (not shown) are located at the surface of guiding rollers 50*u* and 50L. Guiding rollers 50*u* and 50L are movable and are inserted at guiding groove 48L because the width which is the small diameter of guiding groove is more narrow than guiding groove 48L and the width which is the large diameter of guiding groove is wider than guiding grooves 48L. Guiding rollers 51*u* and 51L which are rotatable and attached at first sliding base 45*u* are inserted at guiding groove 48*r*. Also, guiding rollers 52*u* and 52L, which are attached at second sliding base 45L are inserted at guiding groove 59L and guiding rollers 53*u* and 53L which are attached at second sliding base 45L are inserted at guiding grooves 59*r*. These rollers 51*u*, 51L, 52*u*, 52L, 53*u*, 53L are the same shape as guiding rollers 50*u* and 501.

Figure 10:
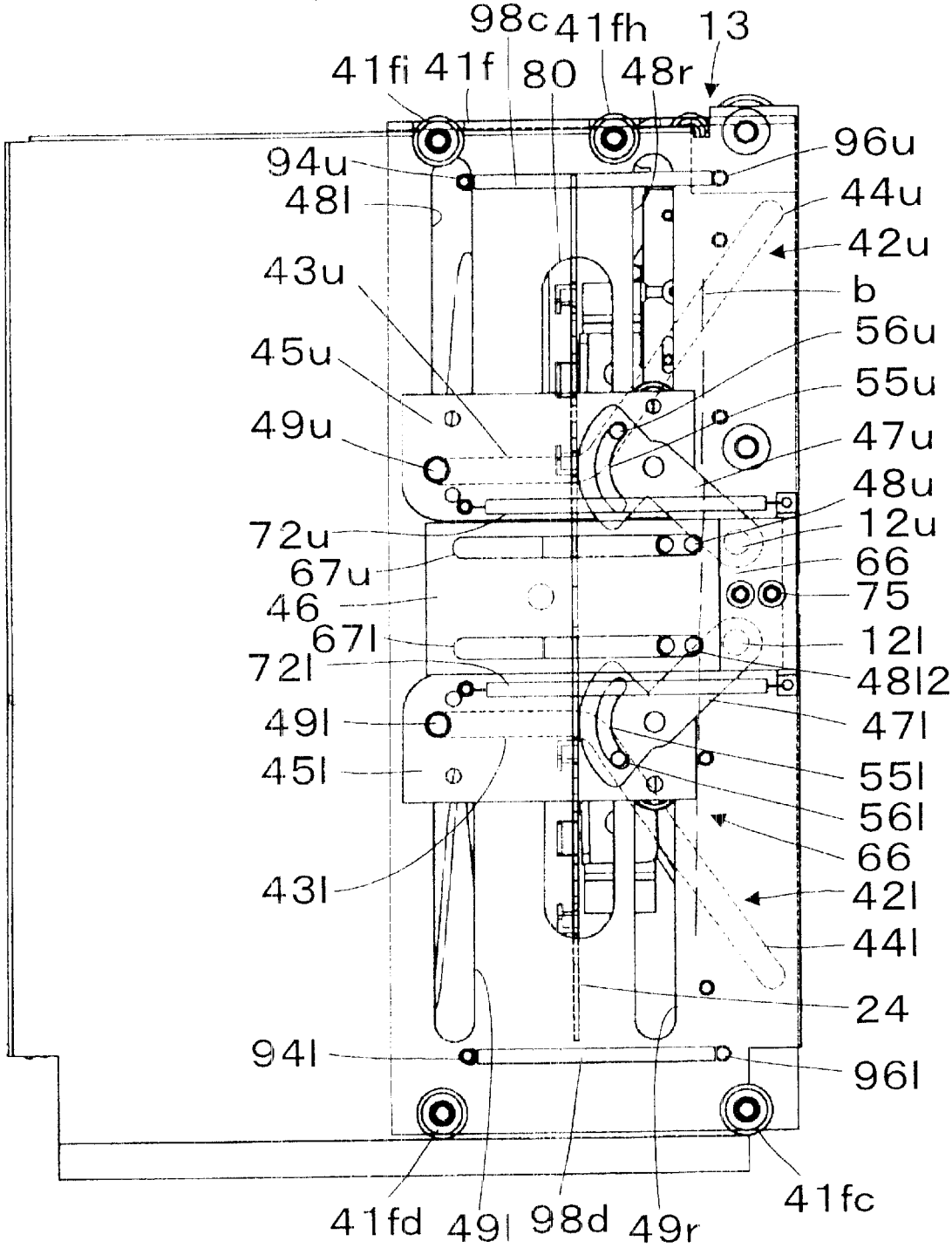
FIG. 10 is a view of the first embodiment in a standby state.

First storing bar 12*u* is fixed at the end of first lever 47*u*. Second storing bar 12L is fixed at the end of second lever 47L. First storing bar 12*u* and second storing bar 12L are located parallel and are across from safe 11 and are extended near back wall 20*b*. The left hand section of first lever 47*u* is sector-like in shape. First arc groove 55*u*, which is centered at first pin 46*u*, is formed at the left hand section of first lever 47*u*. First stopper 56*u*, which is pin-like in shape and which protrudes from first-sliding base 45*u*, is inserted at first arc groove 55*u*. First lever 47*u* is urged in the counterclockwise direction by springs (not shown) as shown in FIG. 4 and is kept at the predetermined position, because first stopper 56*u* has contact with the end of first arc groove 56*u*. Therefore, first storing bar 12*u* corresponds to a bill receiving mouth 23 over a bill temporarily storing section 66 as shown in FIG. 10.

Second arc groove 55L is located at the left hand section of second lever 47L. Second stopper 56L, which protrudes from second sliding base 45L is inserted at second arc groove 55L. First lever 47L is urged in the counterclockwise direction by springs (not shown) as shown in FIG. 4 and is kept at the predetermined position, because second stopper 56L has contact with the end of second arc groove 55L. Therefore, second storing bar 12L corresponds to bill receiving mouth 23. Also bill temporarily storing section 66 is located between second storing bar 12L and bill receiving mouth 23. First pin 49*u* is fixed at first sliding base 45*u* and is inserted at first cam groove 43*u*. Second pin 49L is fixed at sliding base 45L and is inserted at second cam groove 42L. First pin 48*u* and second pin 48L2, which protrude from the inner surface of driving frame 41*f*, are inserted at first elongated hole 67*u* and second elongated hole 67L, which are parallel at the upper and lower end section. First pin 48*u* and second pin 48L2 consist of two pins which are cylinder-like in shape and which are parallel, because sliding base 46 and 46*p* are parallel. The pins can be changed to a rectangle board.

Springs 72*u* and 72L are hooked between arms 70*u* and 70L which are fixed at sliding base 46 and pins 71*u* and 71L which are fixed at the inner surface of driving frame 41*f* Sliding base 46 is normally pulled towards the left (shown in FIG. 4) and is located at a stationary position because first pin 48*u* and second pin 48L2 are stopped by the ends of first elongated hole 67*u* and second elongated hole 67L. Also, second sliding base 46*p*, which has the same structure as sliding base 46 is located at back wall 20*b* side. The explanation of second sliding base 46*p* is omitted, but the same parts are attached to the same number.

Holding bar or contact member 75 is fixed at sliding base 46 and second sliding base 46*p*. Holding bar 75 is located between first storing bar 12*u* and second storing bar 12L and is extended horizontally. Holding bar 75 is usually structured by two bars. However, the holding bar 75 can be made up of only one bar. Sliding base 46 and second sliding base 46*p* are not guided. Therefore, first pin 48*u*, second pin 48L2 and holding bar 75 are flat because the position of sliding base 46 and second sliding base 46*p* are controlled. Forcing piece 76 is the right hand end of sliding base 46, which is bent in a L-shape. If forcing piece 76 moves, it has contact with first lever 47*u* and second lever 47L. T-shape guiding groove 80, which is the lying T character shape, is located at front wall 20*f* of safe 11. T-shaped guiding groove 80 consist of straight section 81*s* and bill guiding section 81*e*. Straight section 81*s* is extended between guiding groove 48L and 48*r*, and between guiding groove 59L and 59*r*. Bill guiding section 81*e* continues to bill receiving mouth 23. A restraining elongated hole 87, in which holding bar 75 can move, is located at back wall 20*b*. Restraining elongated hole 87 is level and is extended over the most carry forward position, as shown in FIG. 6 (pusher 24 can move to the right until it has contact with first bill holder 90*u* and second bill holder 90L).

First bill holder 90*u* is rotatable and attached to shaft 91*u* which is fixed at front wall 20*f* and back wall 20*b*, as shown in FIG. 6. First bill holder 90*u* is ski board-like in shape and is extended towards safe 11. Second bill holder 90L is rotatable and attached to shaft 91L which is fixed at front wall 20*f* and back wall 20*b*. The shape of second bill holder 90L is the same as first bill holder 90*u*. The space which is located between the end of first bill holder 90*u* and the end of second bill holder 90L is the same distance from bill receiving mouth 23. The end of first bill holder 90*u* is located near first right hand wall 21*u*. Therefore, it forms a slant surface which, with the lower section of first right hand wall 21*u* is semicircle-like in shape. The end of second bill holder 90L is located near the second right hand wall 21L. It has a slanted surface which is near the upper section of second right hand wall 21L which is semicircle-like in shape. Bill storing space 99 is surrounded by pusher 24, first bill holder 90*u*, and second bill holder 90L.

The operation of the first embodiment is explained by referring to FIGS. 10, 11, 12, 13, and 14. The bills are not stored in safe 11 at the initial stage. First, a standby situation is explained by referring to FIG. 10. Driving frame 41*f* moves towards the right by springs 98*a*, 98*b*, 98*c*, and 98*d*, and the right end has contact with the inner surface of outer case 10 (not shown). As a result, it is located at a stationary position. In this situation, first pin 49*u* is located at the left end section of first level section 43*u* of first cam groove 42*u*. Second pin 49L is located at the left end section of second level section 43L of second cam groove 42L. Therefore, first sliding base 45*u* is located at the most lower position. Second sliding base 45L is located at the most upper position. Also, sliding base 46 moves towards the right by springs 72*u* and 72L. However, first pins 48*u* and 48L2, which protrude from driving frame 41*f*, have contact with the left ends of first elongated hole 67*u* and second elongated hole 67L. As a result, it comes to a rest.

Forcing piece 76 is situated away from first lever 47*u* and second lever 47L. Therefore, first lever 47*u* pivots in the counterclockwise direction. As a result, first arc groove 55*u* has contact with first stopper 56*u* and is in the standby state. Second lever 47L pivots in the clockwise direction. As a result, second groove 55L has contact with second stopper 56L and is also in the standby state. In the positions of first lever 47*u* and second lever 47L, first holding bar 12*u* and second holding bar 12L are located across the counter bill storing section 22 side. Pusher 24 moves towards the right by springs 26*u* and 26L as shown in FIG. 10 and pushes towards first bill holder 90*u* and second bill holder 90L with the predetermined force. Sliding piece 39 is pushed towards the bill storing section 22 by driving frame 41*f*. Therefore, pin 17 moves towards the left by slanting elongated holes 39*v* and 39*w*. Therefore, rollers 36L, 36*c*, 36*r*, 37L, 37*c*, and 37*r* have contact with belts 33L, 33*c*, and 33*r* by leaf-springs 38L, 38*c*, and 38*r*.

Next, bill b is inserted into accepting device 2 and if the bill b is distinguished as genuine money, then bill b is transported to bill storing device 3 by transporting device 4. Bill b is received from receiving opening 13 to transporting device 3 and is transported to bill temporary storing section 66 by bill transporting device 30*u* which is synchronized with transporting device 4 to provide an initial storage position for the received bill. In other words, shaft 30*a* is pivoted in the counterclockwise direction as shown in FIG. 6. As a result, bill b is drawn between belts 33L, 33*c* and 33*r* and rollers 36L, 36C and 36*r* and moves downward. The lower section of bill b passes through at the side of bill receiving opening 23 and is located at the side of second right wall 21L. Bill b is guided to a bill temporary storing section 66 which is located at the right of second right hand wall 21L, because second right hand wall 21L is shifted from first right hand wall 21*u*, and the upper section of second right hand wall 21L is semicircle-like in shape. When sensor s1, which is located in front of receiving opening 13, detects bill b, it outputs a stop signal. Bill accepting device 2 stops at this location based on this stop signal. As a result, transporting device 4 and bill transporting device 30*u* are also stopped. Therefore, as shown in FIG. 10, bill b is temporarily stored at bill storing section 66 wherein the upper section of the bill is located and held at bill transporting device 30*u*.

Next, crank 17 pivots by one rotation in the clockwise direction at rotating shaft 19 by a motor (not shown). Pin 18 slides into elongated hole 16 towards the left by the front semi-rotation of crank 17, and pushes driving piece 15 towards the left shown in FIG. 2. Therefore, driving piece 15 moves toward the left at slow speed. Driven pin 41 also moves in the same direction. Driving frame 41*f* moves towards the left with driven pin 41. Sliding base 46 also moves in the same direction as driving frame 41*f*. As this process occurs, first lever 47*u* and second lever 47L are pivoted by forcing piece 76. As a result, first lever 47*u* is pivoted in the clockwise direction and second lever 47L is pivoted in the counterclockwise direction.

Figure 11:
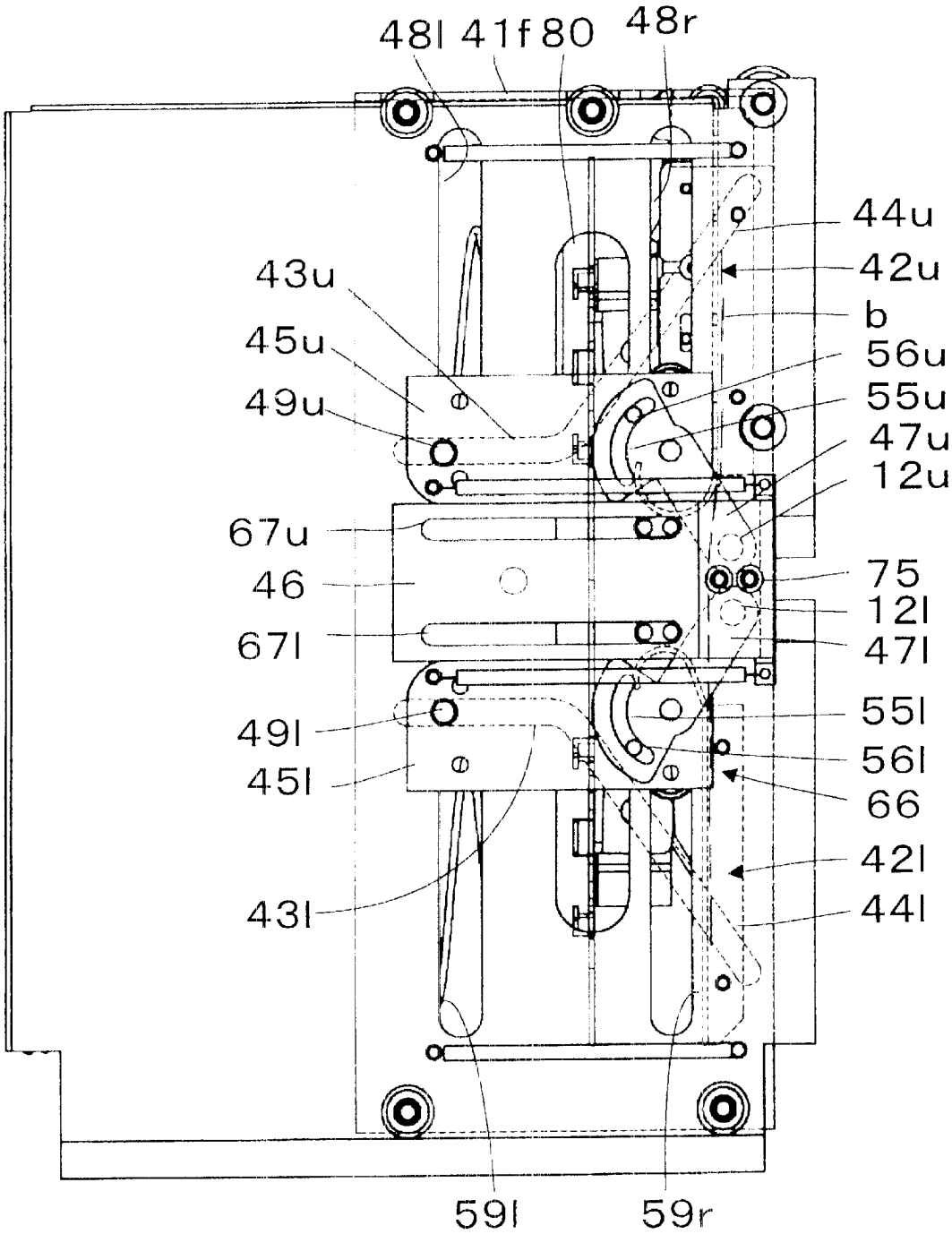
FIG. 11 is a view of the first embodiment with the storing bars in contact with a bill.
Figure 12:
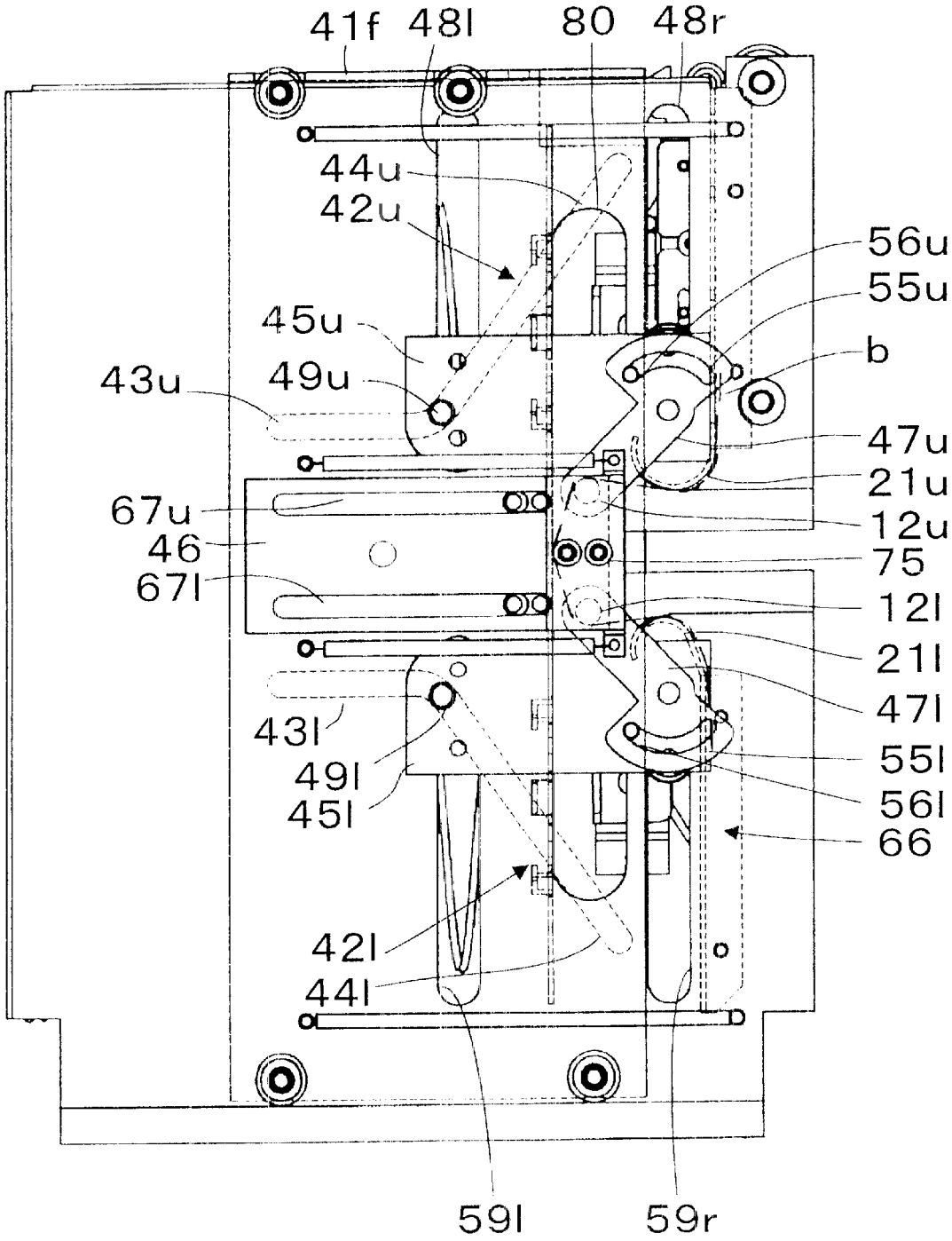
FIG. 12 is a view of the first embodiment with the bill being drawn into the safe by the storing bars.
Figure 13:
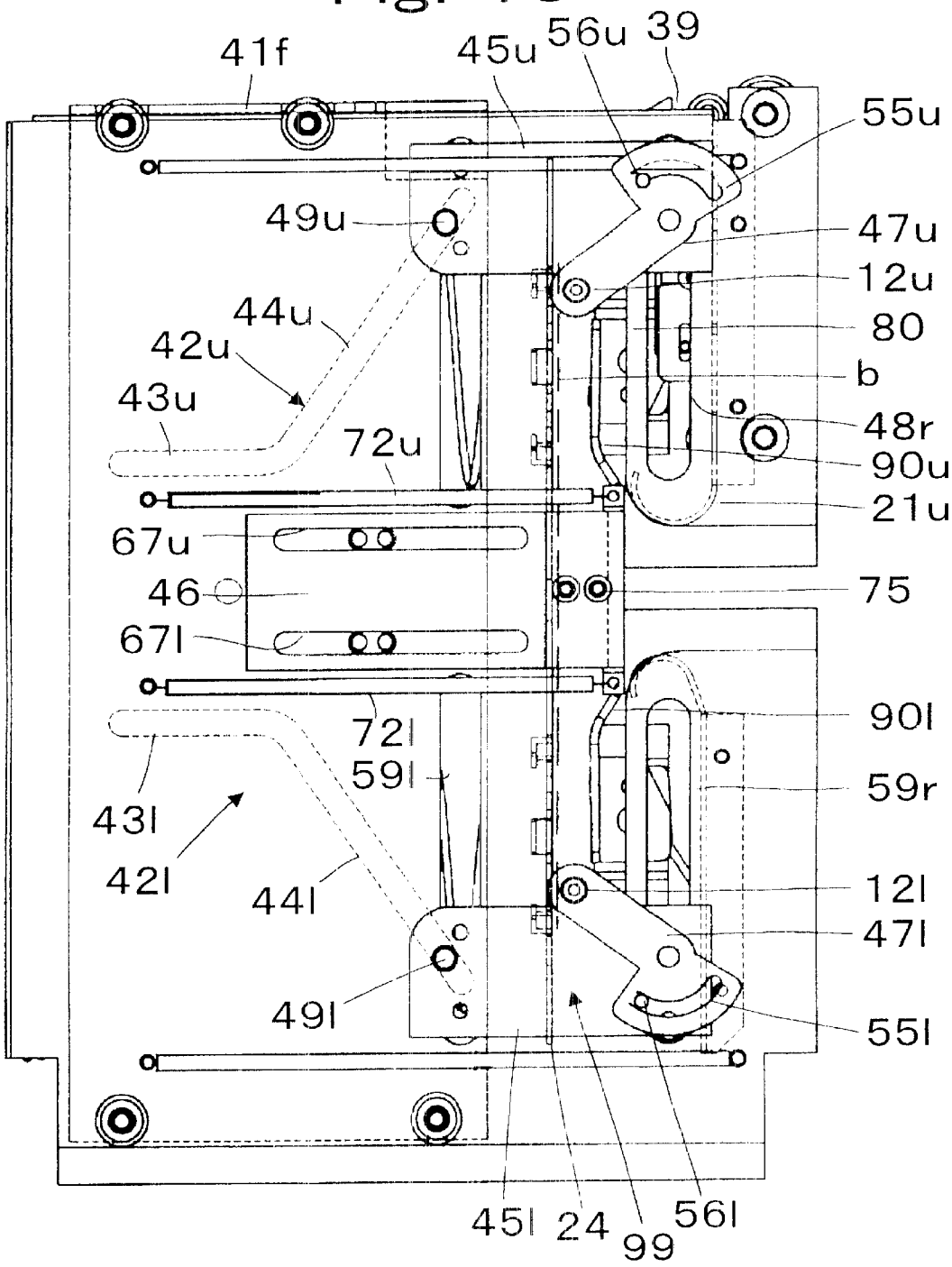
FIG. 13 is a view of the first embodiment where the bill is completely drawn into the safe by the storing bars.

As shown in FIG. 11, holding bar 75, which moves with forcing piece 76, has contact with bill b, which is located at the bill temporarily storing section 66. Next, first lever 47*u* and second lever 47L, which pivot, have contact with bill b. In this situation, first pin 49*u* and second pin 49L are located at level section 43*u* and 43L. As a result, first sliding base 45*u* and second sliding base 45L are located at the position. As shown in FIG. 12, driving frame 41*f* moves towards the left. Therefore, holding bar 75, first storing bar 12*u*, and second storing bar 12L come together at the temporarily storing section 66 and receiving opening 23 goes towards bill storing section 22. As this process occurs, first lever 47*u* does not pivot, because the end of first elongated hole 55*u* has contact with first stopper 56*u*. Also, second lever 47L does not pivot, because the end of second elongated hole 55L has contact with second stopper 56L. Holding bar 75 stops because it has contact with the left hand end of elongated hole 87. As a result, sliding base 46 does not move towards the left. In this state, holding bar 75 pushes bill b towards the spring biased pusher 24. Therefore, the middle of bill b, which is located at the bill temporarily section 66, is pushed from bill receiving opening into bill storing section 22 by holding bar 75, first storing bar 12*u*, and second storing bar 12L, wherein the bill is bent into a u-shape. Holding bar 75, first storing bar 12*u*, and second storing bar 12L, move from bill receiving opening 23 to straight section 81*s* of T-shaped guiding groove 80 through bill receiving section 81*e*. In this situation, first pin 49*u* and second pin 49L are located at the starting section of first slanting section 44*u* and second slanting section 44L. Therefore, first sliding base 45*u* and second sliding base 45L are located at the before position. Driving frame 41*f* slightly slides off from sliding piece 39. As a result, sliding piece 39 is pulled upwards. Therefore, pin 17 moves towards the left by slanting elongated holes 39*v* and 39*w*, as shown in FIG. 8. As a result, rollers 36L, 36*c*, 36*r*, 37L, 37*c*, and 37*r* are slightly away from belts 33L, 33*c*, and 33*r*. Also, driving frame 41*f* moves towards the left as shown in FIG. 13. First pin 49*u* is located at first slanting section 44*u* of first cam groove 42*u*. Second pin 49L is located at second slanting section 44L of second cam groove 42L. Therefore, first pin 49*u* is pushed up towards the upper section and second pin 49L is pushed down towards the lower section with the accompaniment of driving frame 41*f* moves towards the left. First sliding base 45*u* is guided by guiding grooves 48L and 48*r*, and moves upwards. Also, second sliding base 45L is guided by guiding grooves 59L and 59*r*, and moves downwards.

Therefore, first storing bar 12*u* passes through and between the left hand edge of straight section 81*s* and first bill holding or retaining member 90*u*, and it moves to the lower section of straight section 81*s*. Second storing bar 12L passes through between the left-hand edge of straight section 81*s* and second bill holder 90L and moves to the end section of straight section 81*s*. In this process of movement bill b is extended into a flat configuration and stands upright for storage as an array of bills and the bill is pushed towards pusher 24 by the first storing bar 12*u* and the second storing bar 12L to be located at bill storing section 99. In this process of movement, first lever 47*u* moves into an upper position and stops pivoting in the counterclockwise direction by first bill holder 90*u*. As a result, when first storing bar 12*u* is moved away from the upper section of first bill holder 90*u*, first lever 47*u* pivots in the counterclockwise direction and first storing bar 12*u* has contact with the right hand edge of straight section 81*s* of T-shaped guiding groove 80. Also, second lever 47L moves into a lower position and stops pivoting in the clockwise direction by second bill holder 90L. When second storing bar 12L is moved away from the lower section of second bill holder 90L, second lever 47L pivots in the clockwise direction, and second storing bar 12L has contact with the right-hand edge of straight section 81*s* of T-shaped guiding groove 80.

Figure 14:
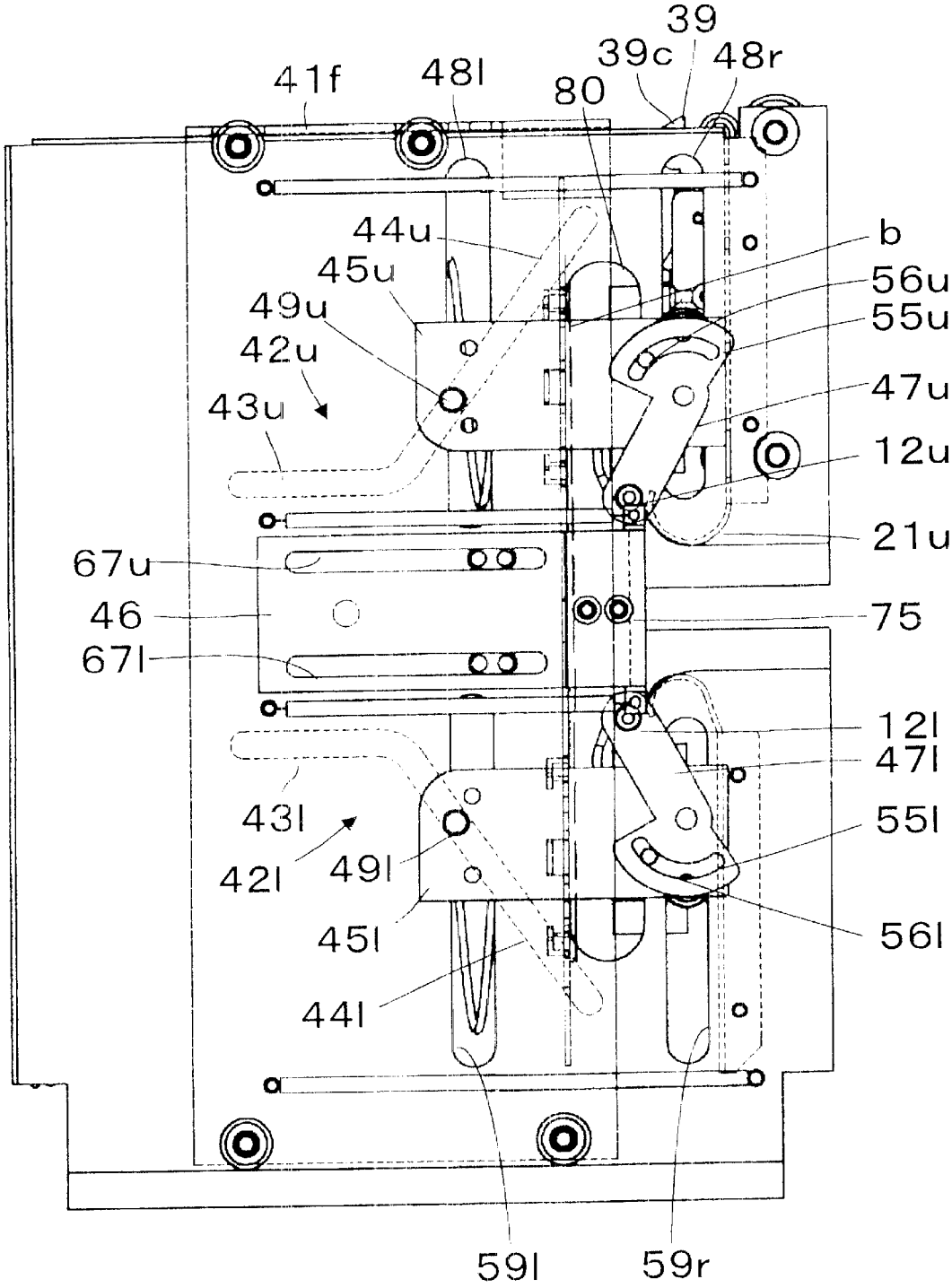
FIG. 14 is a view of the first embodiment where the storing bars are returned to the predetermined position.

Next, the further semi-rotation of crank 17 is explained. Driving piece 15 moves towards the right by the rotation of crank 17. Therefore, driving frame 41*f* moves towards the right by springs 98*a*, 98*b*, 98*c*, and 98*d*. Together, driven pin 41 has contact with driving piece 15. As shown in FIG. 14, when driving frame 41*f* moves towards the right, first slanting section 44*u* pushes down on first pin 49*u*. Therefore, first sliding base 45*u* moves downwards. First, storing bar 12*u* is guided by the right-hand section of T-shaped guiding groove 80 and moves downwards because first sliding base 45*u* moves downwards. Afterwards, first storing bar 12*u* is pivoted in the counterclockwise direction until it is stopped by piece 76.

In this process of movement, first bill holder 90*u* slightly pivots by first storing bar 12*u* and first storing bar 12*u* passes through and between first bill holder 90*u* and first right hand wall 21*u*. Also, second slanting section 44L pushes up on second pin 49L, and second sliding base 45L moves towards the same direction. Second storing bar 12L moves upwards by the upwards movement of second sliding base 45L and is guided by the right-hand section of T-shaped guiding groove 80. Afterwards, second lever 47L pivots in the counterclockwise direction along entry section 81*e* until it is stopped by pushing piece 76 of sliding base 46. In this process of movement, second bill holder 90L slightly pivots by second storing bar 12L and second storing bar 12L passes through and between first bill holder 90L and first right hand wall 21L. Afterwards, driving frame 41*f* moves towards the right. Therefore, first lever 47*u* pivots in the counterclockwise direction and also moves towards the right side and is stopped by first stopper 56*u*. Second lever 47L pivots in the clockwise direction and is stopped by second stopper 56L. As a result, it goes to the standby state. In this process of movement, driving frame 41*f* has contact with slanting surface 39*c*, 39*d*, and they are pushed downwards. Pin 17 moves towards the right through slanting elongated hole 39*v* and 39*w*, based on that sliding piece 39 moves downwards.

As a result, rollers 36L, 36*c*, 36*r*, 37L, 37*c*, and 37*r* are pushed to belts 33L, 33*c*, and 33*r* again. First storing bar 12*u* and second storing bar 12L move along straight section 81*s* of T-shape guiding groove 80 in bill storing section 22. As a result they move in an oblong shape. As a result of the configuration and arrangement of operative parts, the bill storing device 3 is compact in design.

Figure 15:
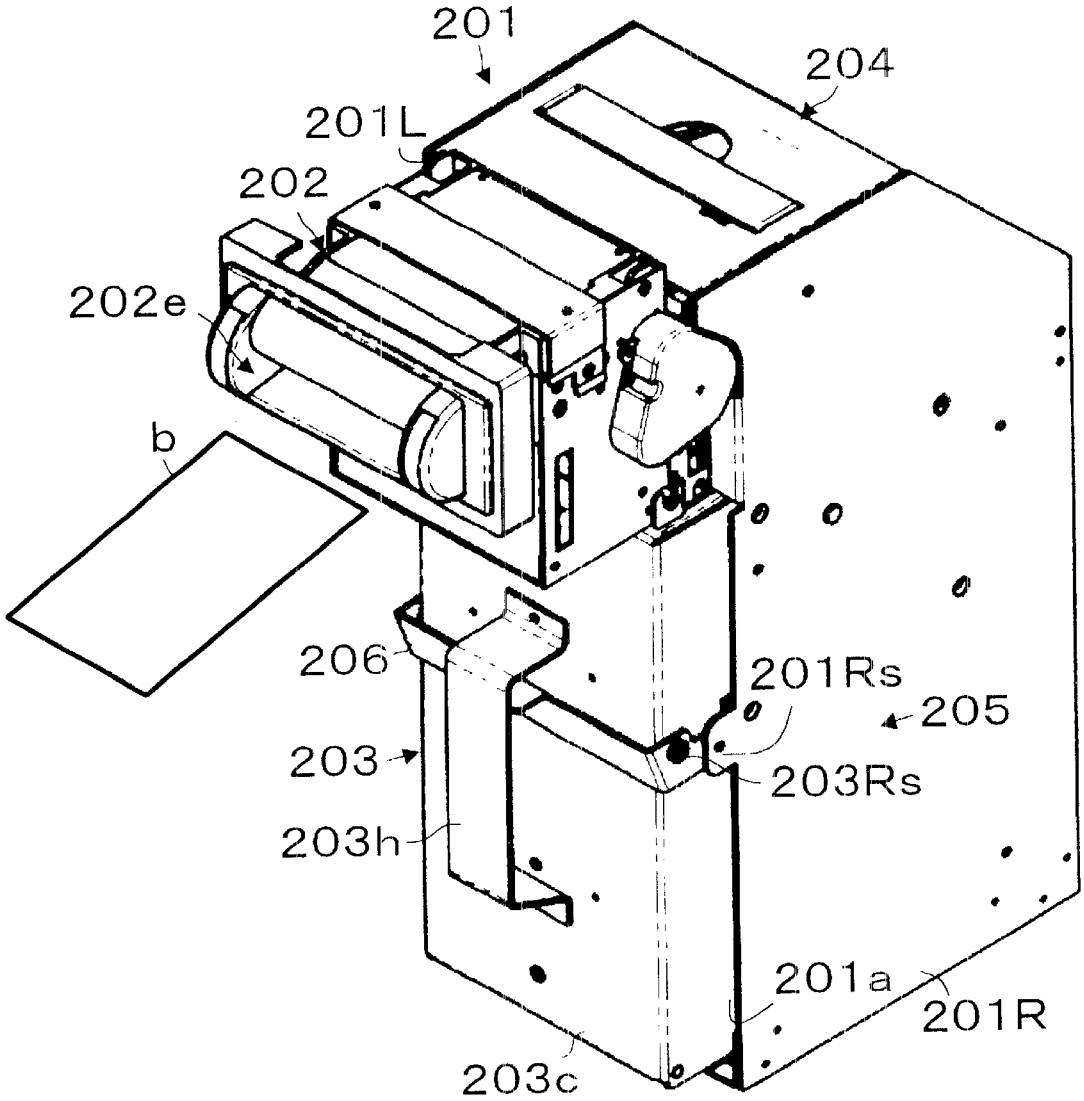
FIG. 15 is a perspective view of a bill accepting storing device of a second embodiment.

The structure of a second embodiment of a receiving storing device 201 of the present invention is explained by referring to FIG. 15. Bill receiving storing device 201 comprises a bill acceptor 202 which distinguishes valid or genuine bills, a bill storing device 203, and a transporting device 204. In other words, bill b, which is accepted from bill receiving slot 202*e*, is distinguished by bill acceptor 202. The valid bills are transported to bill storing device 203 by belt 204*b* of transporting device 204 and is stored in bill storing box 230.

Bill storing device 203 is detachable at storing section 201*a* which is rectangle-like in shape and which is located below transporting device 204, and is locked by locking device 205. Locking device 205 comprises pin 201Rs which is fixed at the right hand side cover 201R, pin 201Ls which is fixed at the left hand side cover 201L and locking lever 206 which is channel-like in shape and which pivots at shafts 203Ls, 203Rs which are fixed at both sides of the outside cover 203*c* of bill storing device 203. Lock device 5 comprises of pin 1Rs which is fixed at the left hand side cover 201*r*, pin 201Ls, which is fixed at the right hand side cover 201L and the locking lever which is channel-like in shape and which pivots at shafts 203Ls and 203*rs* which are fixed at the outside cover 203*c*. Slanting guide section 206L*s* and 206Rs and u-shaped grooves 206Lu and 206Ru are formed at hooking section 206L and 206R are located at both sides of outside cover 203*c*. Locking lever 206 pivots in the clockwise direction by spring (not shown) in FIG. 16, and is stopped by outside cover 203*c*. When bill storing device 203 is located at storing section 201*a*, u-grooves 206Lu and 206Ru are engaged with pins 201Ls and 201Rs, and bill storing device 203 is kept at the predetermined position.

Figure 18:
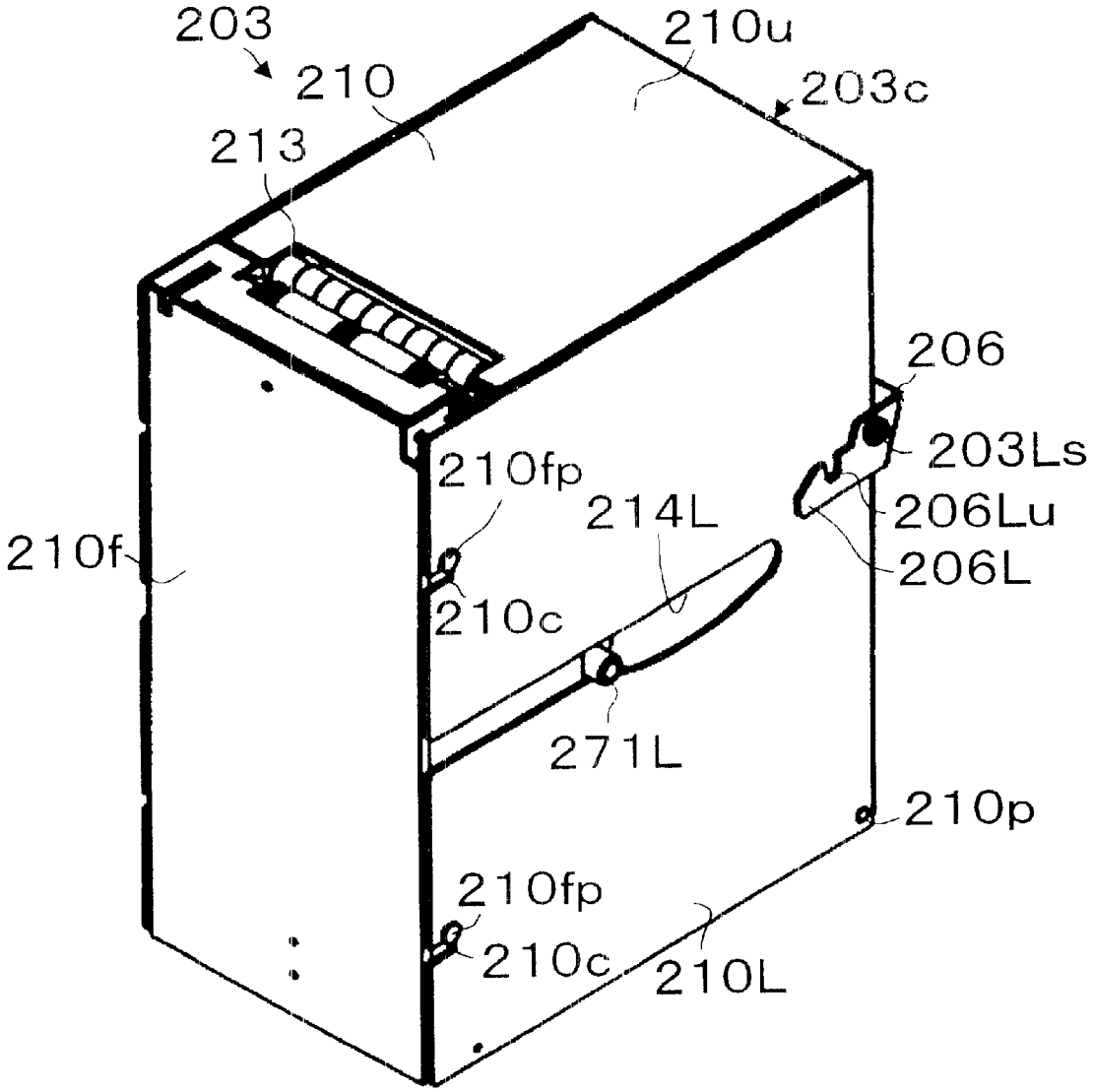
FIG. 18 is a rear perspective view of a portion of the second embodiment.
Figure 19:
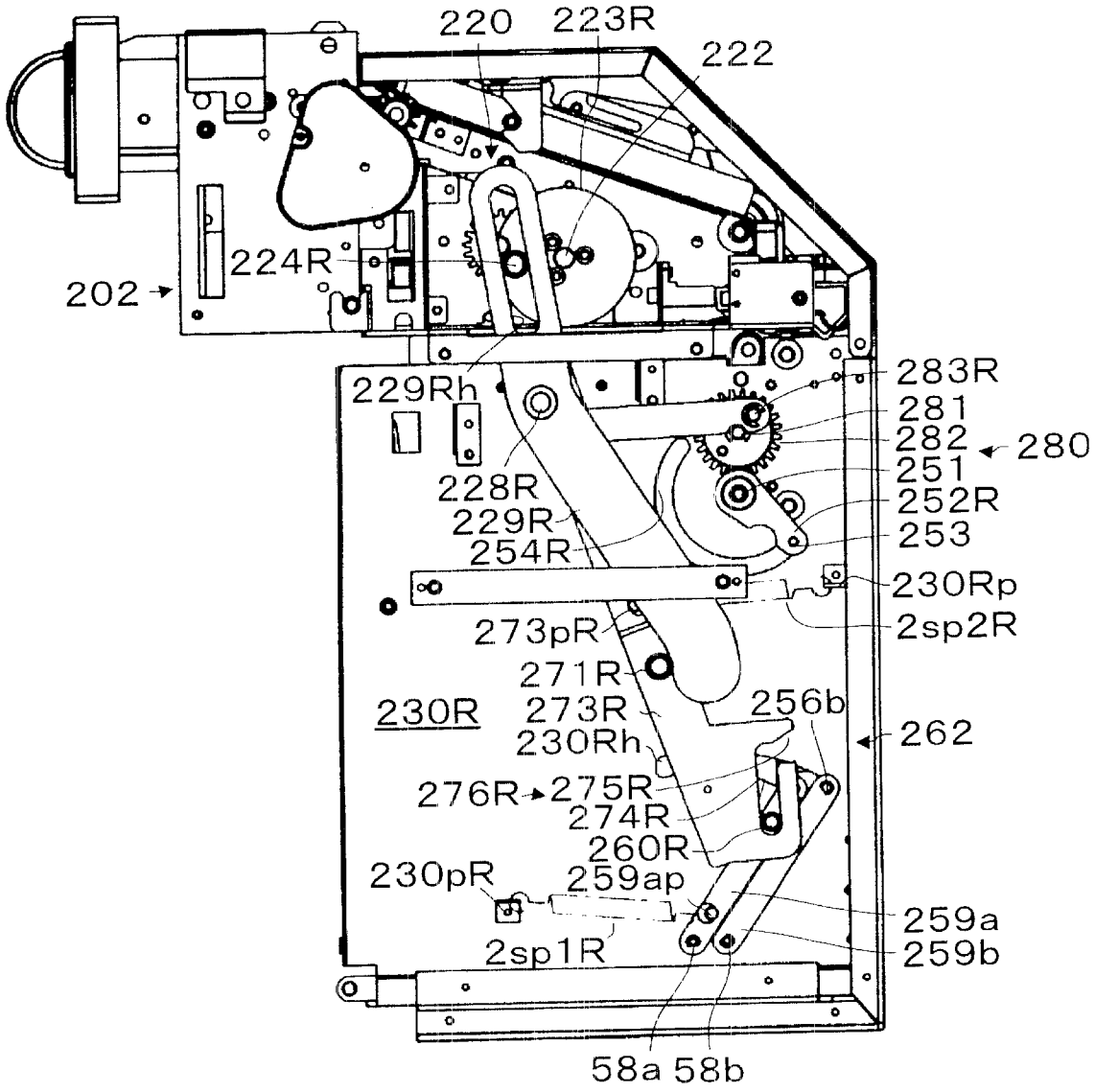
FIG. 19 is a right side elevated view of the second embodiment with the right side cover removed.

In this state, receiving slot 213 of bill storing device 203 is located opposite to the exit of transporting device 204 shown in FIG. 18. Handle 203*h*, which is channel like in shape of bill storing device 203 is fixed at the side of bill receiving slot 2*e* of bill storing device 203. Bill storing device 203 is attached or detached by operating handle 203*h*. Operating piece 206*p* is located at the space which is enclosed by handle 203*h* and outside cover 203*c*. In this structure, if somebody grips the handle 203*h*, it can move upwards, and operating piece 206*p* can be pushed up by the root of an index finger, and u grooves 206Ls, 206Rs are unengaged from pins 201Ls and 201Rs, and locking device 205 is unlocked. Bill receiving storing device 201 can be built into a vending machine.

Figure 21:
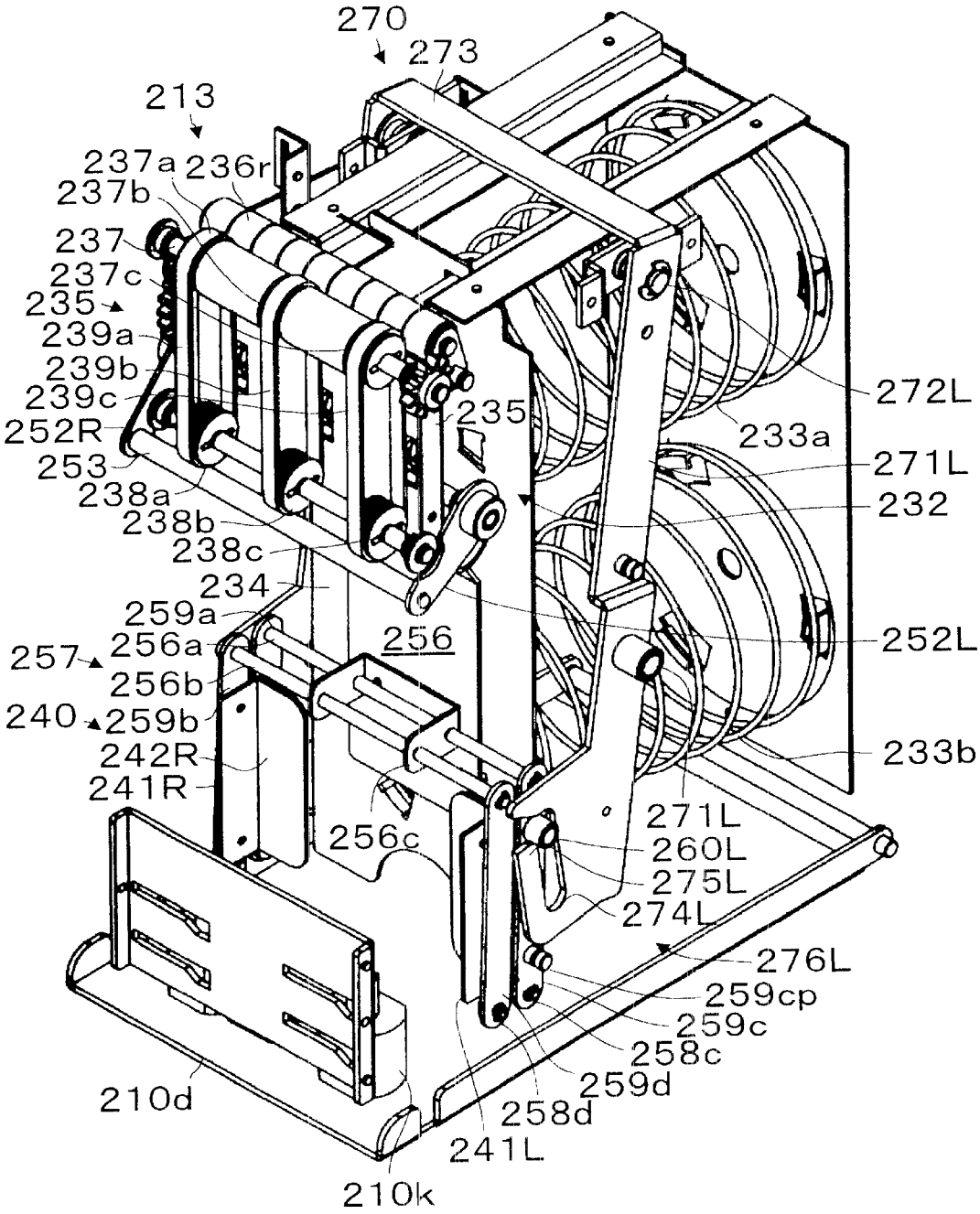
FIG. 21 is a perspective view of the second embodiment with the side plates removed.

Outside cover 203*c*, which is box-like in shape comprises outside case 210 which has an opening at the bottom and at the back, take out door 210*d* and lid 210*f*. The bottom opening of outside case 20 is closed by bill taking door 210*d* which pivots on shaft 210P. Bill taking door 210*d* is locked by locking device 210*k* to the outside case (shown in FIGS. 21 and 22). Lid 210*f* is attachable or detachable to the outside case 210 wherein pin 201*fp* which is fixed at lid 201*f* is engaged at L-shaped groove 210*c* of left-hand cover wall 210L. The left hand structure has the same structure. Slot 213, which is slit-like in shape receives the bills from transportation and is located at the upper cover wall 210*u* of outside case 210. The elongated hole 214L is perforated at left hand cover wall 210L of outside case 210. The elongated hole 214R is perforated at right hand cover wall 210R of outside case 210. Driven pins 271L and 271R of storing driving device 270 protrude over the left hand cover wall 210L and right hand cover wall 210R which pass through elongated hole 214L and 214R.

Figure 16:
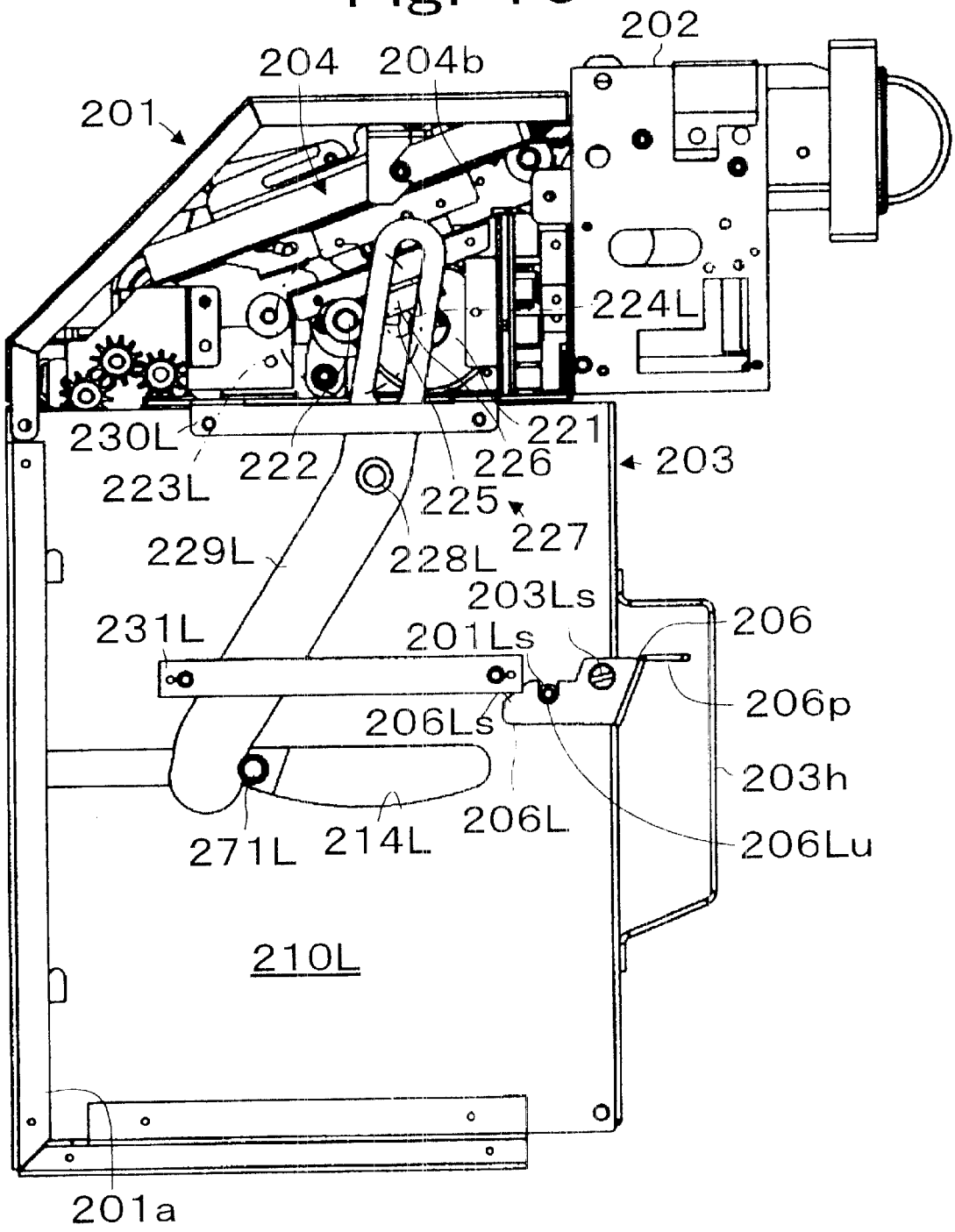
FIG. 16 is a left side elevated view of a second embodiment with the outside frame removed.
Figure 17:
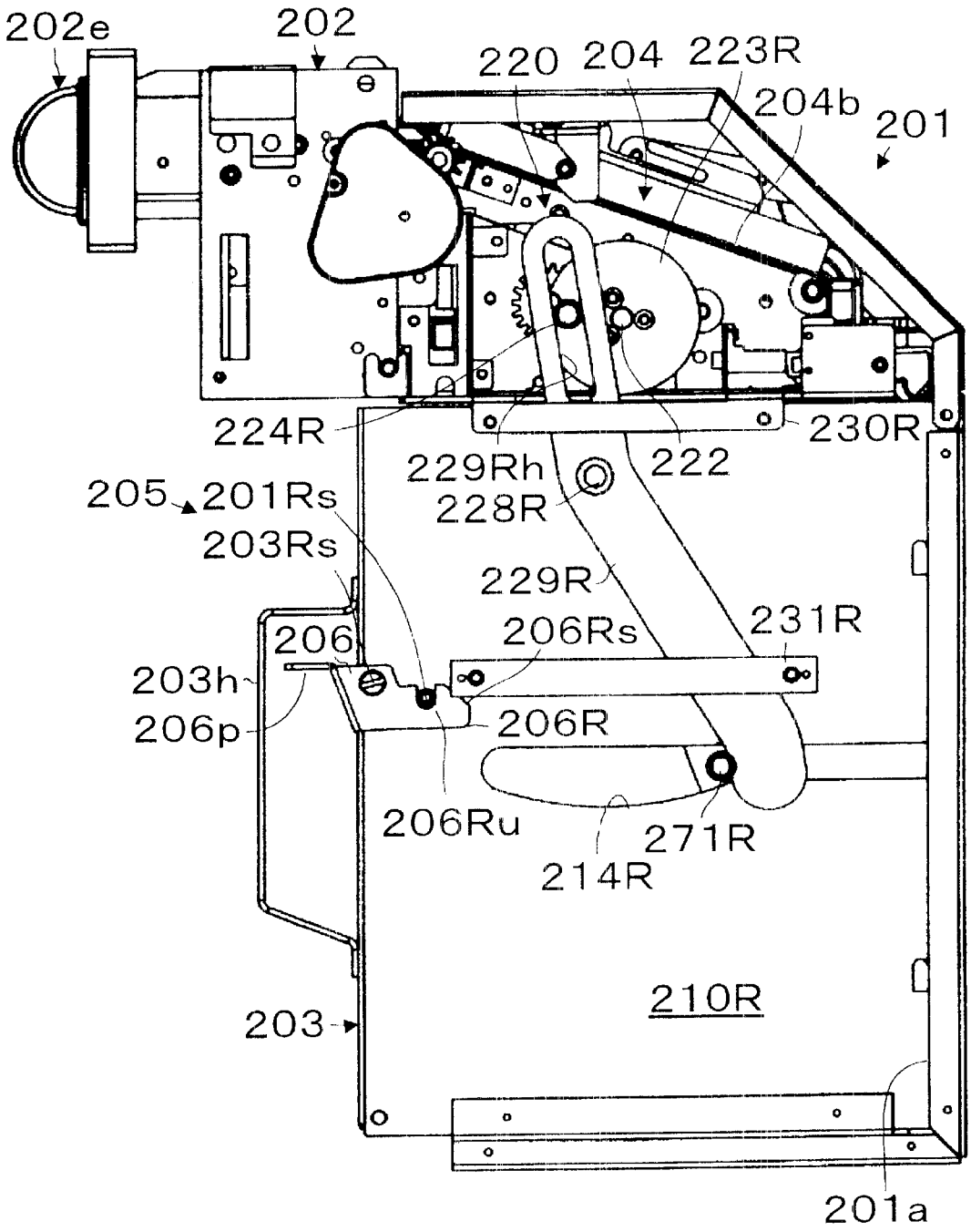
FIG. 17 is a right side elevated view of the second embodiment with the outside frame removed.

Next, driving device 220 of bill storing device 203 is explained (refer to FIGS. 16 and 17). Electric motor 221 has a reducer assembly. The reducer assembly has rotating shaft 222 which rotates by an electric motor 221 which is located in the triangular space and is surrounded by bill acceptor 202, transporting device 204 and storing section 201*a*. Cranks 223L and 223R, which are disk-like in shape, are fixed at the end of rotating shaft 222. Driving pin 224L and 224R are fixed at cranks 223L and 223R, which can rotate.

In the following explanation, each device is located at both sides of bill storing device 203. Therefore, only the right hand device is explained. "L" are attached to left hand parts with same number. Operating piece 225 is fixed at rotating shaft 222. Sensor 226 is fixed at bill receiving storing device 201. Operating piece 225 and sensor 226 make up device 227 (shown in FIG. 16). Fixed shaft 228R is fixed at the inner surface of right hand side cover 210R of storing section 201*a*. Driving lever 229R, which is boomerang-like in shape is attached to fixed shaft 228R. Driving pin 224R is inserted to elongated hole 229Rh at the upper section of driving lever 229R. The lower section of driving lever 229R has contact with driven pin 271R. Driving lever 229R is guided by the elongated hole which is perforated at guide 230R and 231R which are fixed at the inner surface of right hand side cover 201R and it oscillates at the elongated hole. Driving lever 229R moves in a reciprocal motion with one crank of crank 223R. As a result, driven lever 271R pivots in the clockwise direction, and in the reverse the counterclockwise direction by driving lever 229R in FIG. 17.

Next, the structure of inside of outside cover 203*c* is explained (referring to FIGS. 19, 20, 21, and 22). Bill storing box 230, bill transporting device 235, storing driving device 270, storing device 250, and bill holding device 255 are located inside of outside cover 203*c*. Bill storing box 230 comprises left hand wall 230L, right hand wall 230R, upper wall 230U and back wall 230B, and is box-like in shape and can be opened at either the left hand side or the right hand side. The under surface is located opposite to lid 210*d*, and the left hand surface is located opposite to lid 210*f*.

Next, bill storing box 230 is explained. Bill storing box 230 is located outside of case 210 and back wall 230B which is fixed at the bottom of outside case 201, and left hand space 231L, right hand space 231R, and upper space 231U are located between left hand wall 230L, right hand wall 230R, upper wall 230U and outside case 210. Storing driving device 270 is located at left hand space 231L, right hand space 231R and upper space 231U. Storing section 232 is the space which is surrounded by left hand wall 230L, right hand wall 230R, upper wall 230U and back wall 230B. Pusher 234 is attached at the end of springs 233*a* and 233*b* which are fixed at back wall 230B.

Next, storing transporting device 235 is explained. Storing transporting device 235 includes first guide 236 and belts 239*a*, 239*b*, and 239*c*. First guide 236 is a plain board and is fixed at bill storing box 230 so that it extends towards the vertical direction below receiving slot 213. Lower ends 236*e* of first guide 236 is bent towards back wall 230B and is semicircle-like in shape. Roller 236*r* is located right above first guide 236. Tooth pulleys 237*a*, 237*b*, and 237*c* are fixed at shaft 237 which is parallel to roller 236*r* and has a predetermined space. Tooth pulleys 238*a*, 238*b*, and 238*c* are fixed at shaft 238 which is located below shaft 237 and has a predetermined space. Belt 239*a* is positioned around and between pulleys 237*a* and 238*a*. Also, belt 239*b* is positioned around and between pulleys 237*b* and 238*b* and belt 239*c* is positioned around and between pulleys 237*c* and 238*c*. Roller 236*r* has contact with belts 239*a*, 239*b*, and 239*c*. First guide 236 has contact with belts 239*a*, 239*b*, and 239*c*. However, bill b, which is located between first guide 236 and belts 239*a*, 239*b*, and 239*c*, can be pulled without damage. Shaft 237 rotates and interlocks with transporting device 204 for receiving bill b which is sent from transporting device 204. Storing transporting device 235 can be changed from first guide 236 to a belt or to a roller. In its essence, storing transporting device 235 has a function to transport the bills.

Next, transporting guide device 240 is explained. Left hand guide piece 241L and right hand guide piece 241R which are L-like in shape are fixed at the left wall 230*r* and the right wall 230L. In other words, right hand guiding piece 241L and left hand guiding piece 241R are located at a predetermined position. Right hand control surface 242R of right hand supporting piece 241R is parallel to first guide 236, and left hand control surface 242L of left hand supporting piece 241L is also parallel. Right hand control surface 242R and left hand control surface 242L are located away from the pushing board 234 and are located at the other side of an extending line EL.

If the bill oscillates and the lower end of the bill does not have contact with the pushing board 234, the bill moves towards the predetermined direction. Bill receiving passage 245 is the bill passage of storing transporting device 235 and the space which is between transporting guide device 240 and holding board 256. Bill b is stored at the space which is surrounded by pushing board 234, end 236*e*, right hand control surface 242R and left hand control surface 242L.

Next, storing device 250 is explained. Shaft 251 is located above end 236*e* and is rotatable and is supported at right wall 230R and at left wall 230L. Arm 252R is fixed at the end of shaft 251 which protrudes from right wall 230R. Arm 252L is fixed at the end of shaft 251 which protrudes from left wall 230L. Arm 252R and 252L are in the same phase. Storing member 253 is fixed at the end of arm 252L and arm 252R. Storing member 253 is a bar which is round-like in shape. However, it could alternatively be a roller which is desirable, because it would not damage the bills and it does not fold the bills. Storing member 253 passes through an arc groove 245R of right wall 230R and an arc groove 254L of left wall 230L. Storing member 253 waits at the standby position on the right side of extending line EL, and also below pulleys 238*a*, 238*b*, 238*c*. When storing member 253 stores a bill b, it pivots on shaft 251, and is moved across from the extending line EL, and it moves along an arc shaped lower end 236*e*. Afterwards, it returns to its standby position (see FIGS. 22, 24 and 25).

Next, bill holding device 255 is explained. Holding board 256 comprises plane section 256*m* which is located parallel to pushing board 234 and slanting section 256*u* which extends from the plane section 256*m*. Slanting section 256*u* is the upper section of plane section 256*m* which edges away from extending line EL so that it can guide the bill b smoothly as it is moved towards the pushing board 234. The holding board 256 is a plate-like structure and may alternatively be called a holding plate. Similarly, the pushing board 234 is a plate-like structure and may be referred to as a pushing plate.

Holding board 256 is supported by a parallel moving device 257 which has a parallel linkage. First bar 256*a* and second bar 256*b*, which are aligned in rows sideways are fixed at a bracket 256*c* and are channel-like in shape are also fixed at a holding board 256. First bar 256*a* and second bar 256*b* pass through arc-shaped elongated hole 230Rh of right wall 230R and arc-shaped elongated hole 230Lh of left wall 230L. First fixed pin 258*a* and second fixed pin 258*b* are fixed at right wall 230R and they are parallel in the lateral direction. First rod 259*a* links first bar 256*a* and first fixed pin 258*a*. Second rod 259*b* links second bar 256*b* and second fixed pin 258*b*. Third fixed pin 258*c* and fourth fixed pin 258*d* are fixed at left wall 230L and they are paralleled in the lateral direction. Third rod 259*c* links first bar 256*a* and third fixed pin 258*c*. Fourth rod 259*d* links second bar 256*b* and fourth fixed pin 258*d*. Pin 260R is fixed at the side of first rod 259*a*. Pin 260L is fixed at the side of third rid 259*c* with opposite pin 260R. Holder board 256 moves parallel in both the left and right direction by parallel linkage (shown in FIG. 22). Fixed pins 258*a* and 258*d* are located at the center of the swing angle of first rod 259*a* and fourth rod 259*d*. The movement distance is limited and is permitted and only is an up and down direction. As a result, holder board 256 does not move bills b.

Spring 2*sp*1R is hooked up between pin 259*ap* which is fixed at first rod 259*a* and engaging piece 230*p*R which is fixed at side wall 230R Spring 2*sp*1L is hooked up between pin 259*cp* which is fixed at third rod 259*c* and engaging piece 230*p*L which is fixed at side wall 230L. Holder board 256 is forced towards pushing board 234 by springs 2*sp*1R and 2*sp*1L. The standby position of holder board 256 is located at the opposite side of pushing board 234 from extending line EL. When holder board 256 holds bill b, it crosses extending line EL, and it passes through between first surface 242L and second surface 242R, and it pushes pushing board 234 to receive a new bill b. Bill holding device 255 comprises holding board 256 and pushing board 234. Transporting guide device 240 is made up of guiding piece 241L, 241R and holding board 256. Receiving slot 261 is located at storing transporting device 235 and bill holding device 255. In other words, it is between the arc-shaped lower end 236*e* and the upper end of holding board 256.

Next, storing driving device 270 is explained. Lever 273R can pivot shaft 272R which is fixed at right wall 230R. lever 273L can pivot shaft 272R which is fixed at left wall 230L. Levers 273R and 273L are a part of lever 73 which is channel-like in shape. Lever 273R moves at right hand space 231R and lever 273L moves at left hand space 231L. Driven pin 271R is fixed to the middle of lever 273R. Driven pin 271L is fixed to the middle of lever 273L. Second spring 2*sp*2R is hooked up between pin 273*p*R which is the middle of lever 273R and engaging piece 230R*p* side wall 230R. Third spring 2*sp*2L is hooked up between pin 273*pl* which is the middle of lever 273L and engaging piece 230L*p* on side wall 230L. Lever 273 pivots in the counterclockwise direction by springs 2*sp*2R and 2*sp*2L. The force of springs 2*sp*2R and 2*sp*2L are larger than the force of springs 2*sp*1R and 2*sp*1L. The force of springs 2*sp*1R and 2*sp*1L are larger than the force of springs 233*a* and 233*b*.

Next, parallel driving device 262 of parallel moving device 257 is explained. Elongated hole 274R which is elongated in the vertical direction is located at the lower section of lever 273R. Passage 275R which is towards the right and is horn-like in shape continues to the upper section of elongated hole 274R. Guiding groove 276R comprises elongated hole 274R and passage 275R. Pin 260R is located in guiding groove 276R and can slide. When lever 243R pivots in the clockwise direction, pin 260R passes through passage 275R and is away from guiding groove 276R. Also, when lever 243R pivots in the counterclockwise direction, pin 260 moves into guiding groove 276R through passage 275R (shown in FIG. 19). Elongated hole 274L and passage 275L are located at lever 276L and opposed guiding groove 276R. Pin 260L is located at guiding groove 276L and can slide. When lever 273L pivots in the clockwise direction, pin 260L passes through passage 275L and moves away from guiding groove 276L. Also, when lever 273L pivots in the counterclockwise direction, pin 260L moves into guiding groove 276L and passes through passage 275L. Therefore, when pins 260R and 260L are located at guiding grooves 276R and 276L, lever 273R and pin 260R make a pair. The same goes for lever 273L and pin 260L. In the standby situation, second bar 256*b* is located at the standby position which is located at the end section of arc-shaped elongated hole 230Rh and 230Lh.

Next, storing member driving device 280 of storing member 253 is explained. Shaft 281 is mounted at right wall 230R and left wall 230L of the upper section of bill storing box 230, and rotates. Gear 282 is fixed at the end of shaft 281 which protrudes from right wall 230R. Rod 285 links between pin 283 which is fixed at the side of gear 282 and pin 284 which is fixed near shaft 282R at the side of lever 273R. Gear 282 engages to gear 286 which is fixed at shaft 251 (shown in FIG. 22). When levers 273R and 273L are located at the standby position, the engaged-position and the gear ratio are installed so that storing member 253 is located at the standby position which is below shaft 238.

Figure 22:
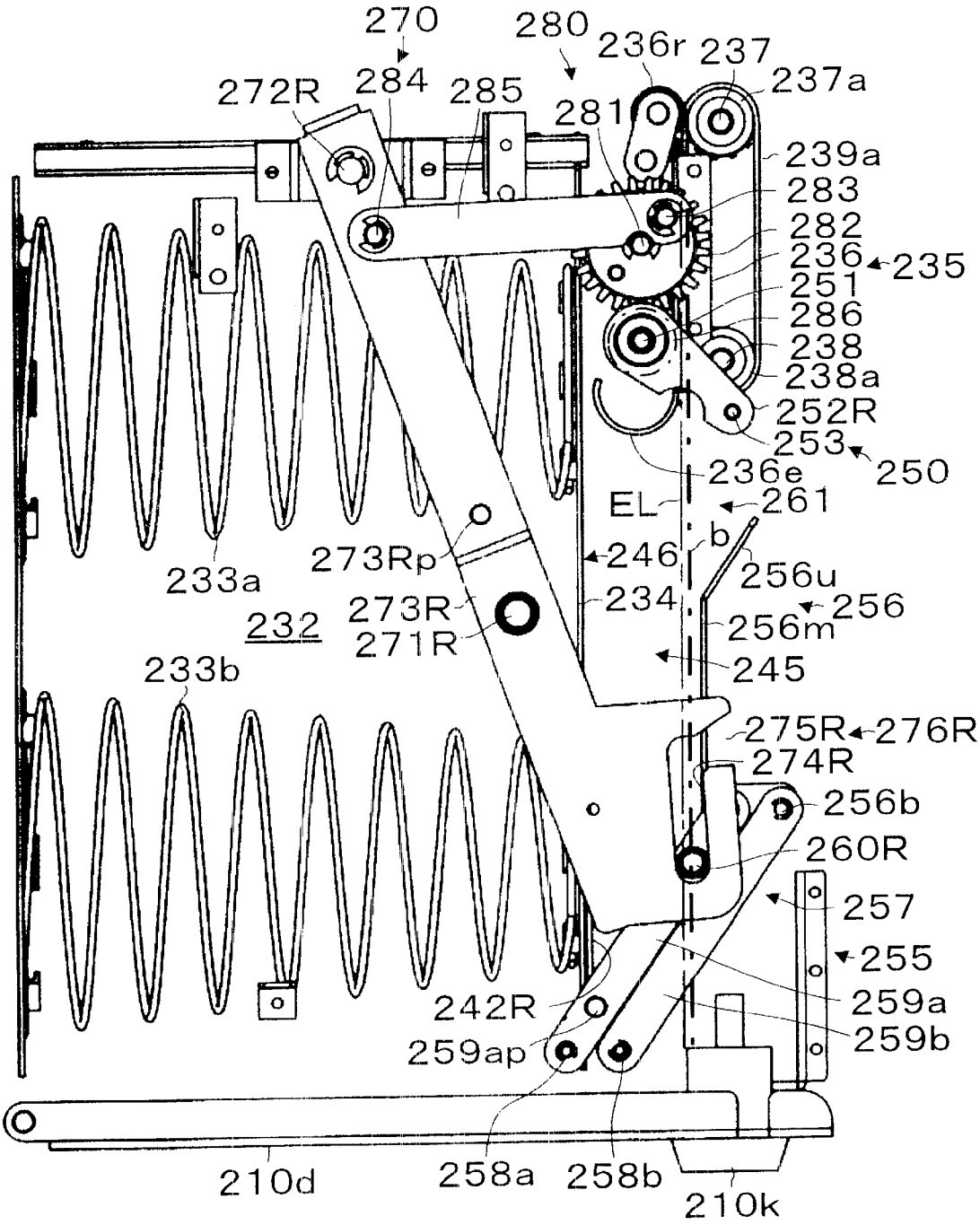
FIG. 22 is a right side elevated view of the second embodiment where the outside cover is taken away.
Figure 24:
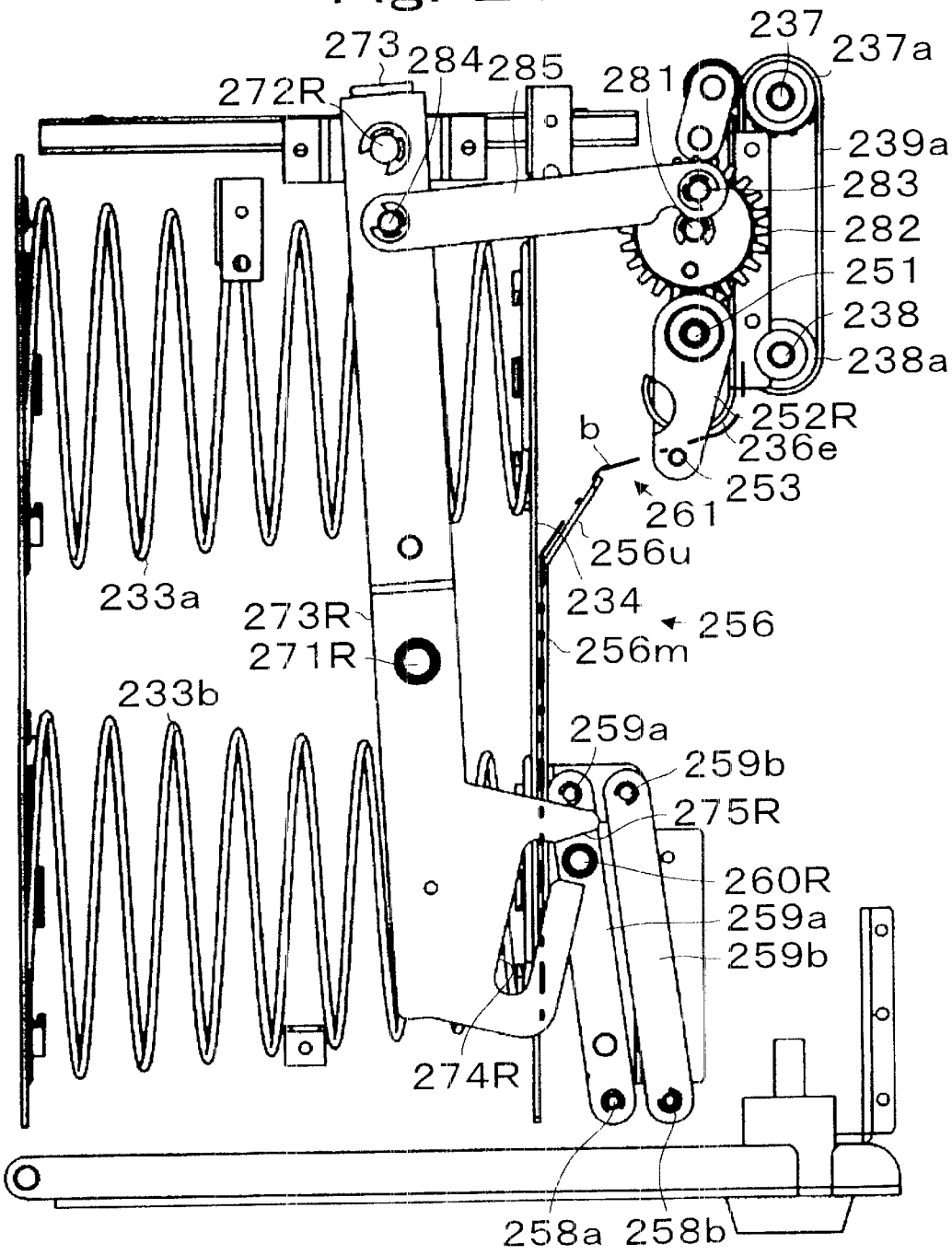
FIG. 24 is a right side elevated view of the second embodiment illustrating a bill being moved to a storing section.
Figure 25:
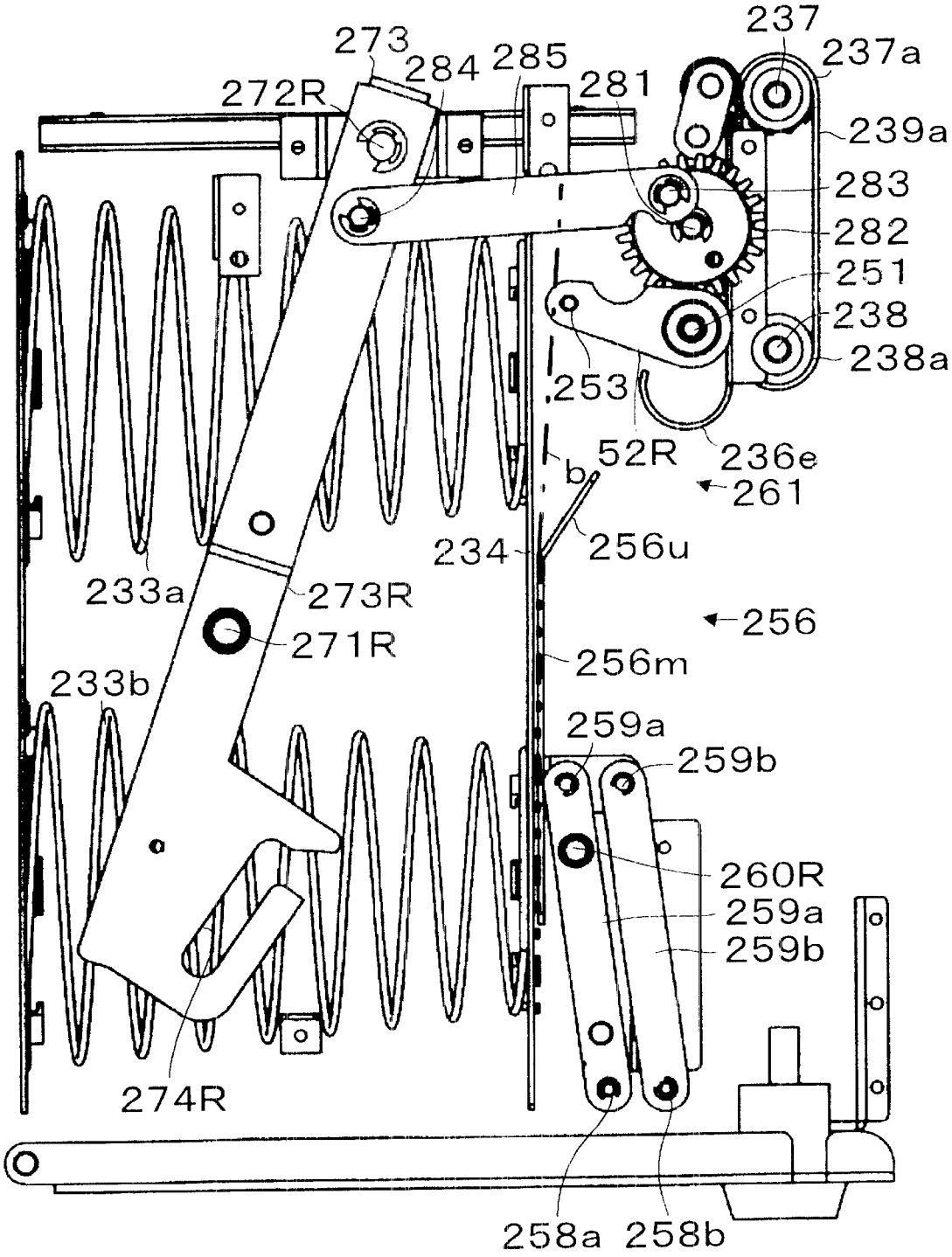
FIG. 25 is a right side elevated view of the second embodiment illustrating the end of a bill drawing operation.

The operation of this second embodiment of the invention is explained by referring to FIGS. 22, 24 and 25. In the initial situation, bill b is not stored in bill storing box 230. First, an operator uses handle 203*h* for installing the bill storing device 203, and it is inserted into storing section 201*a*. As a result, bill storing device is mounted in bill receiving storing device 201. When bill storing device 203 moves into storing section 201*a*, slanting surface 206Rs and 206Ls have contact with pins 201Rs and 201Ls. As a result, lock lever 206 pivots at shaft 3Rs and 3Ls. When u grooves 206Rs and 206Ls come face to face with pins 201Rs and 201Ls, locking lever 206 pivots by a spring (not shown). As a result, hooks 206R and 206L connects with pins 201Rs and 201Ls. In this situation, the exit of transporting device 204 comes face to face with the contact section which is between roller 236*r* and belts 239*a*, 239*b*, and 239*c*.

Next, the standby situation is explained (referring to FIGS. 16 and 17). Driving pins 224R and 224L are located near to accepting device 202. Driving levers 229R and 229L pivot in the counterclockwise direction (shown in FIG. 17). Driving pins 271R and 271L are slightly situated away from driving lever 229R and 229L.

Figure 20:
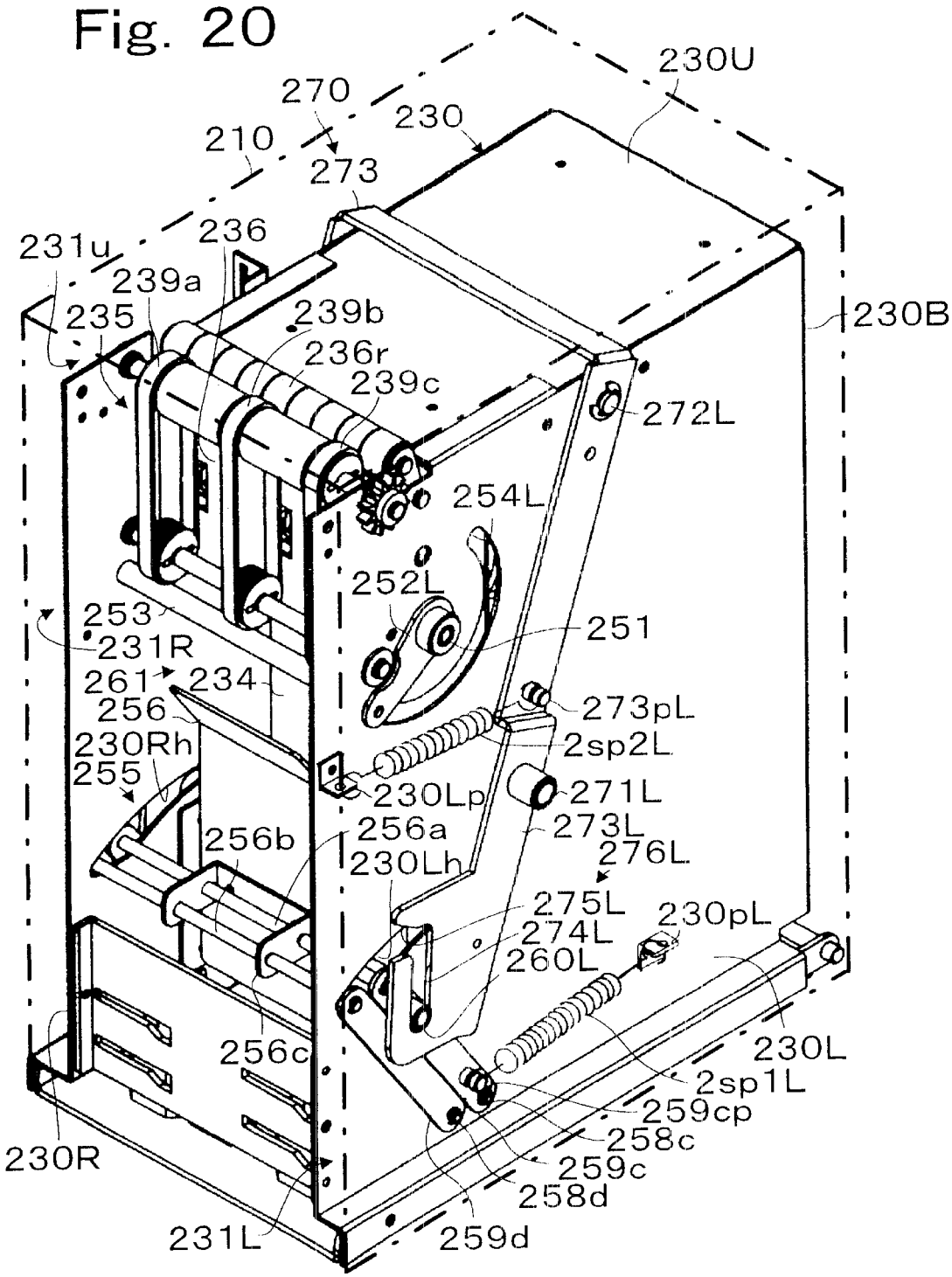
FIG. 20 is a perspective view of the second embodiment with the right hand side cover and the outside cover removed.

The standby state of bill storing device 203 is explained by referring to FIG. 20. Levers 273R and 273L pivot in the counterclockwise direction by spring 2*sp*2R*s* and 2*sp*2L. Pins 260R and 260L of parallel moving device 257 are pushed to the right. As a result, levers 259*a*, 259*b*, 259*c*, and 259*d* pivot in the clockwise direction. Second bar 256*b* is stopped by the end of arc elongated hole 230Rh and 230Lh. Holding board 256 is located at the opposite side of pushing board 234 to extending line EL. Shaft 251 pivots in the counterclockwise direction through pin 284, rod 285, pin 283, gear 282 and 286. As a result, storing member 253 is located away from pushing board 234 and is located at the other side of extending line EL.

When bill b is inserted into bill receiving slot 202*e*, it is sensed by a sensor (not shown) and accepting device 202 is operated. Therefore, accepting device 202 accepts a bill which is transported by the transporting device which moves in a direction towards transporting device 204. Accepting device 202 drives transporting device 204. Therefore, belt 204*b* drives and transports bill b to bill storing device 203. Shaft 237 is driven by transporting device 204 and rotates in the counterclockwise direction (shown in FIG. 22). Belts 239*a*, 239*b*, and 239*c* are circled by shaft 237 in the same direction. Roller 236, which are contacted with belts 239*a*, 239*b*, and 239*c* are rotated in the counterclockwise direction. As a result, bill storing transporting device 235 can pull bill b. If bill b is not distinguished as genuine money by accepting device 202, transporting device 204 is rotated towards the opposite direction and it is returned to bill receiving slot 202*e*. If bill b is distinguished as genuine money, it is transported from transporting device 204 to storing transporting device 235. In storing transporting device 235, bill b is sent downwards by belts 239*a*, 239*b*, 239*c* and roller 236. Also, bill b is sent downwards by first guide 236 and belts 239*a*, 239*b*, 349*c*. The lower end of bill b passes through the hold tight section which is between first guide 236 and belts 239*a*, 239*b*, 239*c*. Afterwards, it moves downwards along extending line EL to bill receiving passage 245. If the lower end strings sideways, it is guided by slanting section 256*u* of holding board 256, left hand control surface 242L and right hand control surface 242R and it moves downwards. When bill b reaches midway of bill receiving passage 245, it is either directly or indirectly detected by a sensor (not shown). As a result, storing transporting device 235 is stopped. In other words, bill b is stopped in the state that the upper section of bill b is held tight between first guide 236 and belts 239*a*, 239*b*, 239*c*. As a result, bill b hangs from between first guide 236 and belts 239*a*, 239*b*, 239*c* at bill receiving passage 245 (shown in FIG. 22).

When motor 221 rotates, cranks 223R, 223L, go into a 360 degree movement. Therefore, cranks 223R, 223L are rotated until the projection of operating piece 225 is fixed at rotating shaft 222 is re-detected by sensor 226. Driving levers 229R, 229L are swung once by driving pings 224R, 224L. Therefore, driving levers 229R and 229L pivot in the clockwise direction and afterwards they pivot in the counterclockwise direction.

Next, when driving levers 229R and 229L pivot in the clockwise direction from the position which is shown in FIG. 22. The operation of storing member 253 and bill holding device 255 is explained. Driven pins 271R and 271L are pushed towards the left in FIG. 22 by levers 273R and 273L. Levers 273R and 273L pivot in the clockwise direction. Pins 260R and 260L are pushed towards the left by levers 273R and 273L and move in the same direction. First rod 259*a* and third rod 259*c* pivot in the counterclockwise direction. Second rod 259*b* and fourth rod 259*d* pivot through bracket 256*c*. Therefore, holding board 256 stays in the vertical position and moves toward the left. As a result, holding board 256 passes through right hand control surface 242R and left hand control surface 242L and has contact with pushing board 234 and pushes pushing board 244 towards the left. The end of bill b is bent into a u shape and passes through the end of right guiding piece 241R and the end of left guiding piece 241L and is transferred from bill receiving passage 245 to bill storing section 232. In this process, levers 273R and 273L, pins 260R and 260L pass through passage 275R and 275L and move away from guiding grooves 276R and 276L. First rod 259*a* and third link 239*c* which move away from levers 273R and 273L pivot in the counterclockwise direction by first spring 2*sp*1R and 2*sp*1L, and are transferred until that first bar 256*a* is stopped by the ends of arc shaped elongated hole 230R*h* and 230L*h*. Therefore, pushing board 234 is pushed towards the left by the holding board 256 which is forced by first spring 2*sp*1R and 2*sp*1L. The upper end of pushing board 234 is located at the back of the storing section 232 and has no contact with storing member 253. At the same time, gear 282 rotates in the counterclockwise direction through pin 284, rod 285, and pin 283 by the rotation in the clockwise direction of levers 273R and 273L. The rotation of gear 82 is synchronized with the swing of levers 273R and 273L.

Bill b is pushed to pushing board 234 by holding board 256 immediately after storing member 253 has contact with bill b (shown in FIG. 24). Shaft 251 goes into a 360 degree roll in the clockwise direction through gear 286 by gear 282. Storing member 253 moves through arms 252R and 252L by the pivot motion of shaft 251. In this situation, storing member 253 moves across extending line EL below shaft 238 and moves around arc shaped lower end 236*e* and goes towards storing section 246 and continues to move upwards (shown in FIG. 25). Storing member 253 moves from receiving slot 261 to bill storing section 246. Therefore, bill b is pushed by storing member 253 and becomes u shaped and moves into storing section 246 along arc shaped lower end 236*e*.

The upper section of bill b is extended by the uphill movement of storing member 253 and is stored flat at storing section 246. Bill b becomes flat by self-frigidity after it passes through pushing board 234 and arc shaped lower end 236*e*. As a result, the uphill movement is minimal.

Figure 23:
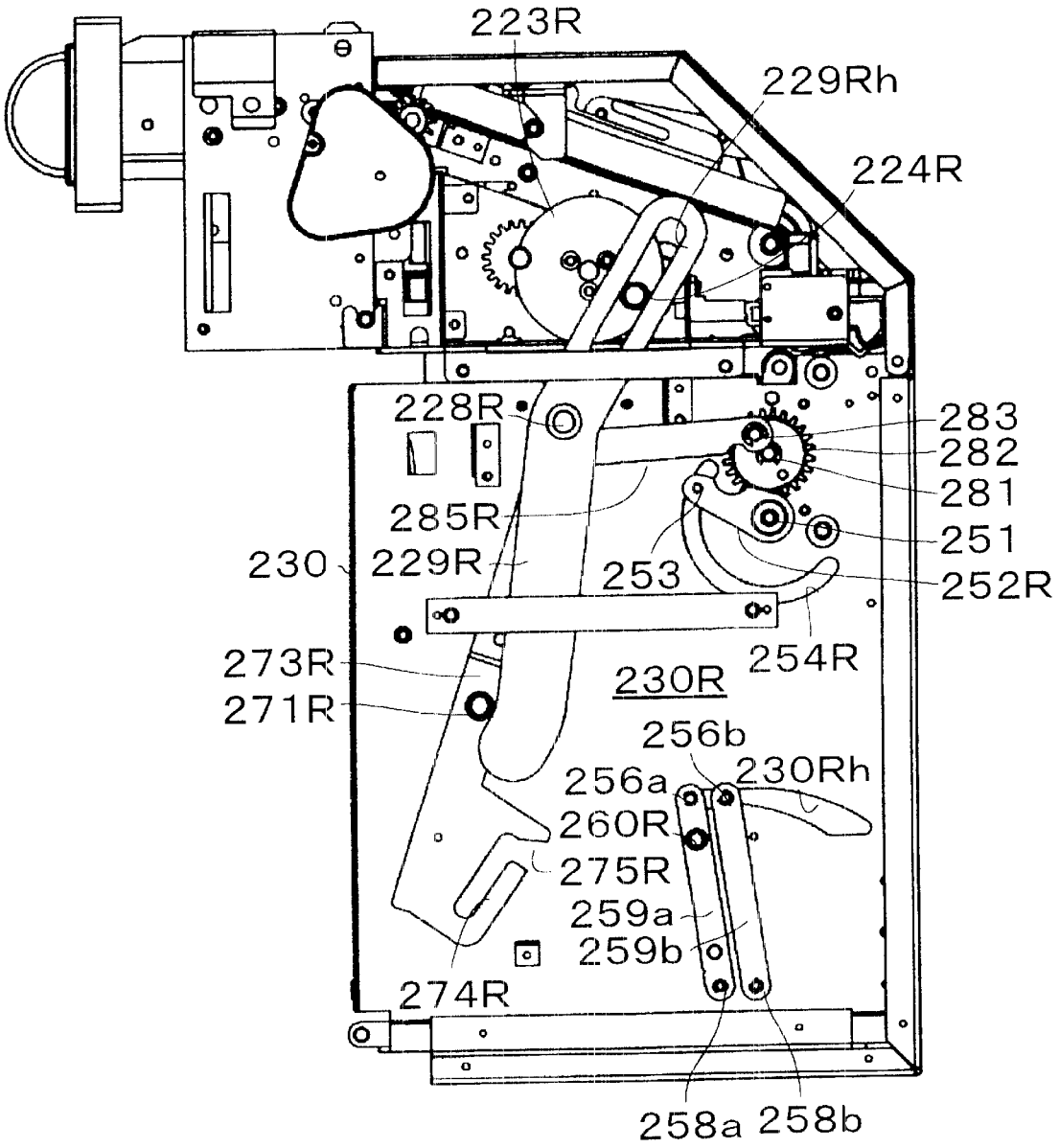
FIG. 23 is a right side elevated view of the second embodiment with the right side cover and the outside cover removed with an illustration of a bill drawing finished.

The operation of storing member 253 and of bill holding device 256 is explained, when driving levers 229R and 229L pivot in the counterclockwise direction away from the position (shown in FIG. 23). Driving levers 229R and 229L also pivot in the counterclockwise direction. At the same time, levers 273R and 273L pivot in the same direction by second springs 2*sp*2R and 2*sp*2L. Therefore, gear 282 rotates in the clockwise direction and shaft 251 rotates in the counterclockwise direction through gear 286. Storing member 253 moves downwards, and moves along arc shaped lower end 236*e*, and goes across extending line EL, and returns to the standby position. When storing member 253 moves downwards, it has contact with bill b which is stored. However, it does not pull down bill b because pushing board 234 has enough space between storing member 253. As a result, the friction force between pushing board 234 and storing member 253 is minimal. When lever 273R and 273L pivot in the counterclockwise direction, pins 260R and 260L move to passages 275R and 275L and move along elongated holes 274R and 274L. Holding board 256 moves towards the right and passes through between right hand control surface 274R and left hand control surface 242L, and moves across extending line EL, and is returned to the standby position. At the same time, pushing board 234 moves towards the right by springs 233*a* and 233*b*. Therefore, bill b, which is stored is held by holding board 256 and pushing board 234, and moves towards the right. However, pushing board 234 is stopped by right hand controller 242R and left hand controller 242L. Received bill b is held by pushing board 234, right hand controller 242R and left hand controller 242L.

In this second embodiment, bill storing device 203 is adjustable and can lie level to acceptance device 202. In this case, right hand controller 242R and left hand controller 242L are located near or to storing transporting device 235. As a result, the end of bill b does not escape from the route.

It should be understood that terms such as "up", "down", "left", and "right" are used to help provide an understanding of this invention and are not necessary to practice the invention. Therefore, the alignment of the bill storing device is not limited. For example, if the bill is equally extended, the holding bar is not used.

Those skilled in the art will appreciate that various adaptations and modifications of the just described preferred embodiments can be configured without department from the scope and spirit of the invention. Therefore, it is to be understood that, within the scope of the appended claims, the invention may be practiced other than as specifically described herein.

What is claimed is:

1. An automatic bill storage device for storing a bill, comprising:

a bill loading device for receiving a bill and positioning the bill at an initial storage position; and a bill contact device for engaging the bill at the initial storage position and translating the bill to a storage location including a holding member for holding a portion of the bill and at least one contact member for contacting an intermediate portion of the bill and translating the bill by a moving contact that extends from the intermediate portion of the bill towards one end of the bill as the bill is moved towards the storage location, a portion of the translated bill being held by the holding member as the contact member moving in contact with the bill extends from the intermediate portion of the bill towards an end of the bill.

2. The automatic bill storage device of claim 1 wherein the contact member pivots about a support member as it moves the bill.

3. The automatic bill storage device of claim 1 further including a second bill contact member for pushing the bill towards the storage location.

4. The automatic bill storage device of claim 1 wherein a pair of contact members pivot respectively about support members as they move the bill.

5. The automatic bill storage device of claim 4 wherein the support members move traverse to the movement of the bill as it moves towards the storage location and each contact member moves towards opposite ends of the bill.

6. The automatic bill storage device of claim 5 further including a second bill contact member for pushing the bill towards the storage location.

7. The automatic bill storage device of claim 6 wherein the bill loading device holds the bill at one end at the initial storage position.

8. The automatic bill storage device of claim 7 wherein the second bill contact member contacts the bill at the initial storage position at the center of the bill.

9. The automatic bill storage device of claim 8 wherein bill loading device includes a holder plate with an aperture adjacent the initial storage position and the contact members engage the bill and force the bill through the aperture as the bill is initially bent and subsequently straightened.

10. The automatic bill storage device of claim 5 wherein the second bill contact member is an elongated bar that extends across a width of the bill.

11. An automatic bill storage device for storing a bill, comprising:

a bill loading device for receiving a bill and positioning the bill at an initial storage position;

a bill contact device for engaging the bill at the initial storage position and translating the bill to a storage location including at least one contact member for contacting an intermediate portion of the bill and translating the bill by a moving contact that extends from the intermediate portion of the bill towards one end of the bill as the bill is moved towards the storage location; and a lever member pivotally mounted in the automatic bill storage device and a spring biased second contact bill member for pushing the bill towards the storage location, the lever member can removably engage the second contact bill member to drive it adjacent the initial storage position for receiving a bill, and after positioning of a bill at the initial storage position, the lever member can pivot to release the spring biased second contact bill member to urge the bill towards the storage location.

12. The automatic bill storage device of claim 11 wherein the lever member is further connected to the contact member to drive the contact member to contact the bill at the intermediate position.

13. An automatic bill storage device for storing a bill, comprising:

a bill storing section to store the bills;

a storing device for transporting the bills entered into the bill storing device to the bill storing section, including a holding member to hold a portion of the bill and a contacting member for moving relative to the holding member, the contacting member contacting an intermediate portion of the bill and moving in contact with the bill towards an end of the bill; and a storing driver unit operatively connected to the storing device to drive the storing device; the storing driver unit is located besides the bill storing section.

14. The automatic bill storage device of claim 13 further including a bill receiving section for entering a bill including a slit opening and the storing device includes a pair of storing bars that contact the bill at the slit opening and move the bill to the bill storing section through the slit opening.

15. The automatic bill storage device of claim 14 further includes a holding device for holding the bill, the pair of storing bars include rotating arm members, and a sliding base which supports the rotating arms.

16. An automatic bill storage device comprising:

a safe unit for storing bills;

a driving frame member which can move in a reciprocal motion adjacent the safe unit with a cam groove;

a sliding base unit which is supported by the safe unit and can move between an entrance for a bill and the safe unit along the cam groove;

a lever pivotally mounted on the sliding base unit; and a contact member attached to the lever for contacting the bill and moving it to the safe unit.

17. The automatic bill storage device of claim 16 wherein the pivotal connection on the lever moves in both a first direction towards and away from the safe unit and in a second direction traverse to the first direction whereby the contact member can contact a bill at an initial storage position and translate the bill by a moving contact from an intermediate portion of the bill towards one end of the bill as the bill is moved towards the safe unit during the reciprocation of the driving frame member.

18. The automatic bill storage device of claim 17 wherein the sliding base unit is divided into a first portion and a second portion, and a second lever is pivotally mounted on the second portion with a second contact member for contacting the bill whereby the sliding base unit includes a first cam groove for contacting the first portion and a second cam groove for contacting the second portion.

19. The automatic bill storage device of claim 18 wherein the safe unit includes a spring biased holding member for biasing the stored bills.

20. The automatic storage device of claim 18 further including a bill loading device for receiving a bill and positioning the bill at a load position including a holder plate with an aperture and the contact members engage the bill and force the bill through the aperture as the bill is initially bent and subsequently straightened.

* * * * *